US007893897B2

(12) United States Patent
Chung et al.

(10) Patent No.: US 7,893,897 B2
(45) **Date of Patent: *Feb. 22, 2011**

(54) VOLTAGE BASED DATA DRIVING CIRCUITS AND DRIVING METHODS OF ORGANIC LIGHT EMITTING DISPLAYS USING THE SAME

(75) Inventors: Bo Yong Chung, Seoul (KR); Do Hyung Ryu, Suwon-si (KR); Hong Kwon Kim, Euiwang-si (KR); Oh Kyong Kwon, Seoul (KR)

(73) Assignee: Samsung Mobile Display Co., Ltd., Suwon-si, Gyeonggi-do (KR)

( * ) Notice: Subject to any disclaimer, the term of this patent is extended or adjusted under 35 U.S.C. 154(b) by 784 days.

This patent is subject to a terminal disclaimer.

(21) Appl. No.: 11/491,880

(22) Filed: Jul. 25, 2006

(65) Prior Publication Data

US 2007/0024542 A1 Feb. 1, 2007

(30) Foreign Application Priority Data

Aug. 1, 2005 (KR) ..... 10-2005-0070438

(51) Int. Cl.
*G09G 3/30* (2006.01)

(52) U.S. Cl. ..... 345/82; 315/169.3

(58) Field of Classification Search ..... 345/36, 345/39, 44–46, 74.1–83; 315/169.3; 313/463
See application file for complete search history.

(56) References Cited

U.S. PATENT DOCUMENTS 6,710,548 B2 3/2004 Kimura (Continued)

FOREIGN PATENT DOCUMENTS

EP 1 796 070 6/2007

(Continued)

OTHER PUBLICATIONS

Hai-Jung In, et al., "A Novel Volage-Programming Pixel with Current-Correction Method for Lage-Size and High-Resoluation AMOLEDs on Poly-Si Backplane", International Meeting on Information Display, IMID'05 Digest, No. 286, pp. 901-904 (Jul. 23, 2005).

(Continued)

*Primary Examiner*—Chanh Nguyen
*Assistant Examiner*—Ram A Mistry
(74) *Attorney, Agent, or Firm*—Lee & Morse, P.C.

(57) ABSTRACT

A data driving circuit for driving pixels of a light emitting display to display images with uniform brightness may include a gamma voltage unit that generates a plurality of gray scale voltages, a digital-analog converter that selects, as a data signal, one of the plurality of gray scale voltages using first data, a decoder that generates second data using the first data, a current sink, a voltage controller that controls a voltage value of the data signal using the second data and a compensation voltage generated based on the predetermined current, and a switching unit that supplies the data signal to the pixel during any partial period of the complete period elapsing after the first partial period. The current sink receives a predetermined current from the pixel during a first partial period of a complete period for driving the pixel based on the selected gray scale voltage.

22 Claims, 10 Drawing Sheets

U.S. PATENT DOCUMENTS

| | | | | |
|---|---|---|---|---|
| 6,806,497 | B2 | 10/2004 | Jo | |
| 6,809,706 | B2 | 10/2004 | Shimoda | |
| 6,859,193 | B1 | 2/2005 | Yumoto | |
| 6,873,117 | B2 | 3/2005 | Ishizuka | |
| 6,950,045 | B2 * | 9/2005 | Kim | 341/118 |
| 7,030,842 | B2 | 4/2006 | Ha et al. | |
| 7,113,156 | B2 | 9/2006 | Hashimoto | |
| 7,432,891 | B2 | 10/2008 | Fruehauf | |
| 2002/0109655 | A1 * | 8/2002 | Yer et al. | 345/87 |
| 2003/0122745 | A1 * | 7/2003 | Miyazawa | 345/76 |
| 2003/0156104 | A1 * | 8/2003 | Morita | 345/204 |
| 2003/0189541 | A1 | 10/2003 | Hashimoto | |
| 2004/0056852 | A1 * | 3/2004 | Shih et al. | 345/204 |
| 2004/0104840 | A1 | 6/2004 | Awata et al. | |
| 2004/0222953 | A1 * | 11/2004 | Smith | 345/87 |
| 2004/0227749 | A1 * | 11/2004 | Kimura | 345/211 |
| 2008/0030438 | A1 | 2/2008 | Marx et al. | |

FOREIGN PATENT DOCUMENTS

| | | | |
|---|---|---|---|
| JP | 10-254410 | A | 9/1998 |
| JP | 11-219146 | A | 8/1999 |
| JP | 2002-311898 | A | 10/2002 |
| JP | 2003-043993 | A | 2/2003 |
| JP | 2003-058106 | A | 2/2003 |
| JP | 2003-140613 | A | 5/2003 |
| JP | 2003-295828 | A | 10/2003 |
| JP | 2004-004675 | A | 1/2004 |
| JP | 2004-125852 | A | 4/2004 |
| JP | 2004-145197 | A | 5/2004 |
| JP | 2004-192000 | A | 7/2004 |
| JP | 2004-287345 | A | 10/2004 |
| JP | 2007-536585 | T | 12/2007 |
| KR | 10-2003-0081080 | | 10/2003 |
| KR | 10-2004-0061902 | | 7/2004 |
| WO | WO 2005/029456 | A1 | 3/2005 |

OTHER PUBLICATIONS

Y. Matsueda, et al., "AMOLED with Integrated 6-Bit Gamma Compensated Digital Data Driver", 2004 SID International Symposium, SID 04 Digest, pp. 1116-1119 (May 25, 2004).

* cited by examiner

VOLTAGE BASED DATA DRIVING CIRCUITS AND DRIVING METHODS OF ORGANIC LIGHT EMITTING DISPLAYS USING THE SAME

BACKGROUND

1. Field of the Invention

The present invention relates to data driving circuits, light emitting displays employing such data driving circuits and methods of driving the light emitting display. More particularly, the invention relates to a data driving circuit capable of displaying images with uniform brightness, a light emitting display using such a data driving circuit and a method of driving the light emitting display to display images with uniform brightness.

2. Description of Related Art

Flat panel displays (FPDs), which are generally lighter and more compact than cathode ray tubes (CRTs), are being developed. FPDs include liquid crystal displays (LCDs), field emission displays (FEDs), plasma display panels (PDPs) and light emitting displays.

Light emitting displays may display images using organic light emitting diodes (OLEDs) that generate light when electrons and holes recombine. Light emitting displays generally have fast response times and consume relatively low amounts of power.

FIG. 1 illustrates a schematic of the structure of a known light emitting display.

As shown in FIG. 1, the light emitting display may include a pixel unit 30, a scan driver 10, a data driver 20 and a timing controller 50. The pixel unit 30 may include a plurality of pixels 40 connected to scan lines S1 to Sn and data lines D1 to Dm. The scan driver 10 may drive the scan lines S1 to Sn. The data driver 20 may drive the data lines D1 to Dm. The timing controller 50 may control the scan driver 10 and the data driver 20.

The timing controller 50 may generate data driving control signals DCS and scan driving control signals SCS based on externally supplied synchronizing signals (not shown). The data driving control signals DCS may be supplied to the data driver 20 and the scan driving control signals SCS may be supplied to the scan driver 10. The timing controller 50 may supply data DATA to the data driver 20 in accordance with externally supplied data (not shown).

The scan driver 10 may receive the scan driving control signals SCS from the timing controller 50. The scan driver 10 may generate scan signals (not shown) based on the received scan driving control signals SCS. The generated scan signals may be sequentially supplied to the pixel unit 30 via the scan lines S1 to Sn.

The data driver 20 may receive the data driving control signals DCS from the timing controller 50. The data driver 20 may generate data signals (not shown) based on the received data DATA and data driving control signals DCS. Corresponding ones of the generated data signals may be supplied to the data lines D1 to Dm in synchronization with respective ones of the scan signals being supplied to the scan lines S1 to Sn.

The pixel unit 30 may be connected to a first power source ELVDD for supplying a first voltage VDD and a second power source ELVSS for supplying a second voltage VSS to the pixels 40. The pixels 40, together with the first voltage VDD signal and the second voltage VSS signal, may control the currents that flow through respective OLEDs in accordance with the corresponding data signals. The pixels 40 may thereby generate light based on the first voltage VDD signal, the second voltage VSS signal and the data signals.

In known light emitting displays, each of the pixels 40 may include a pixel circuit including at least one transistor for selectively supplying the respective data signal and the respective scan signal for selectively turning on and turning off the respective pixel 40 of the light emitting display.

Each pixel 40 of a light emitting display is to generate light of predetermined brightness in response to various values of the respective data signals. For example, when the same data signal is applied to all the pixels 40 of the display, it is generally desired for all the pixels 40 of the display to generate the same brightness. The brightness generated by each pixel 40 is not, however, only dependent on the data signal, but is also dependent on characteristics of each pixel 40, e.g., threshold voltage of each transistor of the pixel circuit.

Generally, there are variations in threshold voltage and/or electron mobility from transistor to transistor such that different transistors have different threshold voltages and electron mobilities. The characteristics of transistors may also change over time and/or usage. For example, the threshold voltage and electron mobility of a transistor may be dependent on the on/off history of the transistor.

Therefore, in a light emitting display, the brightness generated by each pixel in response to respective data signals depends on the characteristics of the transistor(s) that may be included in the respective pixel circuit. Such variations in threshold voltage and electron mobility may prevent and/or hinder the uniformity of images being displayed. Thus, such variations in threshold voltage and electron mobility may also prevent the display of an image with a desired brightness.

Although it may be possible to at least partially compensate for differences between threshold voltages of the transistors included in the pixels by controlling the structure of the pixel circuits of the pixels 40, circuits and methods capable of compensating for the variations in electron mobility are still needed. OLEDs that are capable of displaying images with uniform brightness irrespective of variations in electron mobility are also desired.

SUMMARY OF THE INVENTION

The present invention is therefore directed to a data driving circuit and a light emitting display using the same, which substantially overcome one or more of the problems due to the limitations and disadvantages of the related art.

It is therefore a feature of an embodiment of the present invention to provide a data driving circuit capable of driving pixels of a light emitting display to display images with uniform brightness, a light emitting display using the same, and a method of driving the light emitting display.

At least one of the above and other features and advantages of the present invention may be realized by providing a data driving circuit for driving a pixel of a light emitting display based on externally supplied first data for the pixel, wherein the pixel is electrically connectable to the driving circuit via at a data line, the data driving circuit including a gamma voltage unit generating a plurality of gray scale voltages, a digital-analog converter selecting, as a data signal, one of the plurality of gray scale voltages using k bits of the first data, k being a natural number, a decoder generating p bits of second data using the k bits of the first data, p being a natural number, a current sink receiving a predetermined current from the pixel during a first partial period of a complete period for driving the pixel based on the selected gray scale voltage, a voltage controller controlling a voltage value of the data signal using the second data and a compensation voltage generated based on the predetermined current, and a switching unit supplying the data signal, with the controlled voltage value, to the pixel, the switching unit supplying the data signal during any partial period of the complete period elapsing after the first partial period of the complete period.

The data driving circuit may include a first transistor that may be disposed between the digital-analog converter and the switching unit, the digital-analog converter may be turned on during a predetermined time of the first partial period to transfer the data signal, with the controlled voltage value, to the switching unit, and a first buffer may be connected between the first transistor and the switching unit.

The decoder may convert the first data into a binary weighted value to generate the second data. The gamma voltage unit may include a plurality of distribution resistors for generating the gray scale voltages and distributing a reference supply voltage and a first supply voltage, and a second buffer for supplying the first supply voltage to the voltage controller.

The voltage controller may include p capacitors, each of the p capacitors may have a first terminal that is connected to an electrical path between the first transistor and the first buffer, second transistors respectively connected between a second terminal of each of the p capacitors and the second buffer, and third transistors respectively connected between the second terminal of each of the p capacitors and the current sink, the third transistors may be of a conduction type different from a conduction type of the second transistors. The decoder may turn on the second transistors during the first partial period, and may supply the first supply voltage to the respective second terminals of the p capacitors.

Capacitances of the p capacitors may be set to binary weighted values. The decoder may turn on and off the third transistors based on a number of bits of the second data and during the second partial period, the decoder selectively controls a supply of the compensation voltage to the respective second terminals of the p capacitors.

The current sink may include a current source providing the predetermined current, a first transistor disposed between the data line connected to the pixel and the voltage controller, the first transistor may be turned on during the first partial period, a second transistor disposed between the data line and the current source, the second transistor may be turned on during the first partial period, a capacitor storing the compensation voltage, and a buffer disposed between the first transistor and the voltage controller, the buffer selectively transferring the compensation voltage to the voltage controller.

A current value of the predetermined current may be equal to a current value of a minimum current flowing through the pixel when the pixel emits light with maximum brightness, and maximum brightness corresponds to a brightness of the pixel when a highest one of the plurality of reset gray scale voltages is applied to the pixel. The switching unit may include at least one transistor which is turned on during the second partial period. The switching unit may include two transistors which are connected so as to form a transmission gate.

The data driving circuit may include a shift register unit including at least one shift register for sequentially generating a sampling pulse, a sampling latch unit including at least one sampling latch for receiving the first data in response to the sampling pulse, and a holding latch unit including at least one holding latch for receiving the first data stored in the sampling latch and supplying the first data stored in the holding latch to the digital-analog converter and the decoder. The data driving circuit may include a level shifter for selectively modifying a voltage level of the first data stored in the holding latch and supplying the first data to the digital-analog converter and the decoder.

At least one of the above and other features and advantages of the present invention may be separately realized by providing a light emitting display that receives externally supplied first data and includes a pixel unit including a plurality of pixels connected to n scan lines, a plurality of data lines, and a plurality of emission control lines, a scan driver respectively and sequentially supplying, during each scan cycle, n scan signals to the n scan lines, and for sequentially supplying emission control signals to the plurality of emission control lines, and a data driver receiving a predetermined current from respective ones of the pixels selected by a first scan signal during a first partial period of a complete period, respectively controlling voltage values of data signals using respective compensation voltages generated based on the respective predetermined current and respective second data generated by converting the respective first data into second data using binary weighted values, and respectively supplying the data signals, with the controlled voltage values, to the data lines during a partial period of the complete period that elapses after the first partial period of the respective complete period associated with each of the respective pixels.

Each of the pixels may be connected to two of the n scan lines, and during each of the scan cycles, a first of the two scan lines receiving a respective one of the n scan signals before a second of the two scan lines receives a respective one of the n scan signals, and each of the pixels may include a first power source, an light emitter receiving current from the first power source, first and second transistors each having a first electrode connected to the respective one of the data lines associated with the pixel, the first and second transistors being turned on when the first of the two scan signals is supplied, a third transistor having a first electrode connected to a reference power source and a second electrode connected to a second electrode of the first transistor, the third transistor being turned on when the first of the two scans signal is supplied, a fourth transistor, the fourth transistor controlling an amount of current supplied to the light emitter, a first terminal of the fourth transistor being connected to the first power source, and a fifth transistor having a first electrode connected to a gate electrode of the fourth transistor and a second electrode connected to a second electrode of the fourth transistor, the fifth transistor being turned on when the first of the two scan signals is supplied such that the fourth transistor operates as a diode.

Each of the pixels may include a first capacitor having a first electrode connected to one of a second electrode of the first transistor or the gate electrode of the fourth transistor and a second electrode connected to the first power source, and a second capacitor having a first electrode connected to the second electrode of the first transistor and a second electrode connected to the gate electrode of the fourth transistor.

Each of the pixels may include a sixth transistor having a first terminal connected to the second electrode of the fourth transistor and a second terminal connected to the light emitter, the sixth transistor being turned off when the respective emission control signal is supplied, wherein the current sink receives the predetermined current from the pixel during a first partial period of one complete period for driving the pixel, the first partial period occurring before a second partial period of the complete period for driving the pixel, and the sixth transistor is turned on during the second partial period of the complete period for driving the pixel.

At least one of the above and other features and advantages of the present invention may be separately realized by providing a method for driving a light emitting display that includes selecting, as a data signal, one of a plurality of gray scale voltages based on k bits of externally supplied first data, k being a natural number, converting the first data into a binary weighted value and generating p bits of second data, p being a natural number, receiving predetermined current from a pixel selected by a scan signal during a first partial period of a complete period for driving the pixel based on the selected gray scale voltage, controlling a voltage value of the data signal using the generated second data and a compensation voltage generated when the predetermined current is supplied, and after controlling the voltage value of the data signal, supplying the data signal to the pixel, the data signal being supplied to the pixel during a second partial period of the complete period for driving the pixel.

The method may further involve generating the plurality of gray scale voltages by distributing a voltage between reference supply voltage and a first supply voltage among a plurality of voltage dividing resistors.

Controlling the voltage value of the data signal may include supplying a voltage value of the first power source to a first terminal of a each of a plurality of capacitors during the first, and selectively controlling a supply of the compensation voltage to the respective second terminals of the plurality of capacitors based on a number of bits of the second data, during a second partial period of the complete period.

At least one of the above and other features and advantages of the present invention may be separately realized by providing a data driving circuit for driving a light emitting display that includes selecting means for selecting, as a data signal, one of a plurality of gray scale voltages based on k bits of externally supplied first data, k being a natural number, converting means for converting the first data into a binary weighted value and generating p bits of second data, p being a natural number, receiving means for receiving predetermined current from a pixel selected by a scan signal during a first partial period of a complete period for driving the pixel based on the selected gray scale voltage, controlling means for controlling a voltage value of the data signal using the generated second data and a compensation voltage generated when the predetermined current is supplied, and after controlling the voltage value of the data signal, supplying the data signal to the pixel, the data signal being supplied to the pixel during a second partial period of the complete period for driving the pixel.

BRIEF DESCRIPTION OF THE DRAWINGS

These and other features and advantages of the invention will become apparent to those of ordinary skill in the art by describing in detail exemplary embodiments thereof with reference to the attached drawings in which.

DETAILED DESCRIPTION OF THE INVENTION

Figure 1:
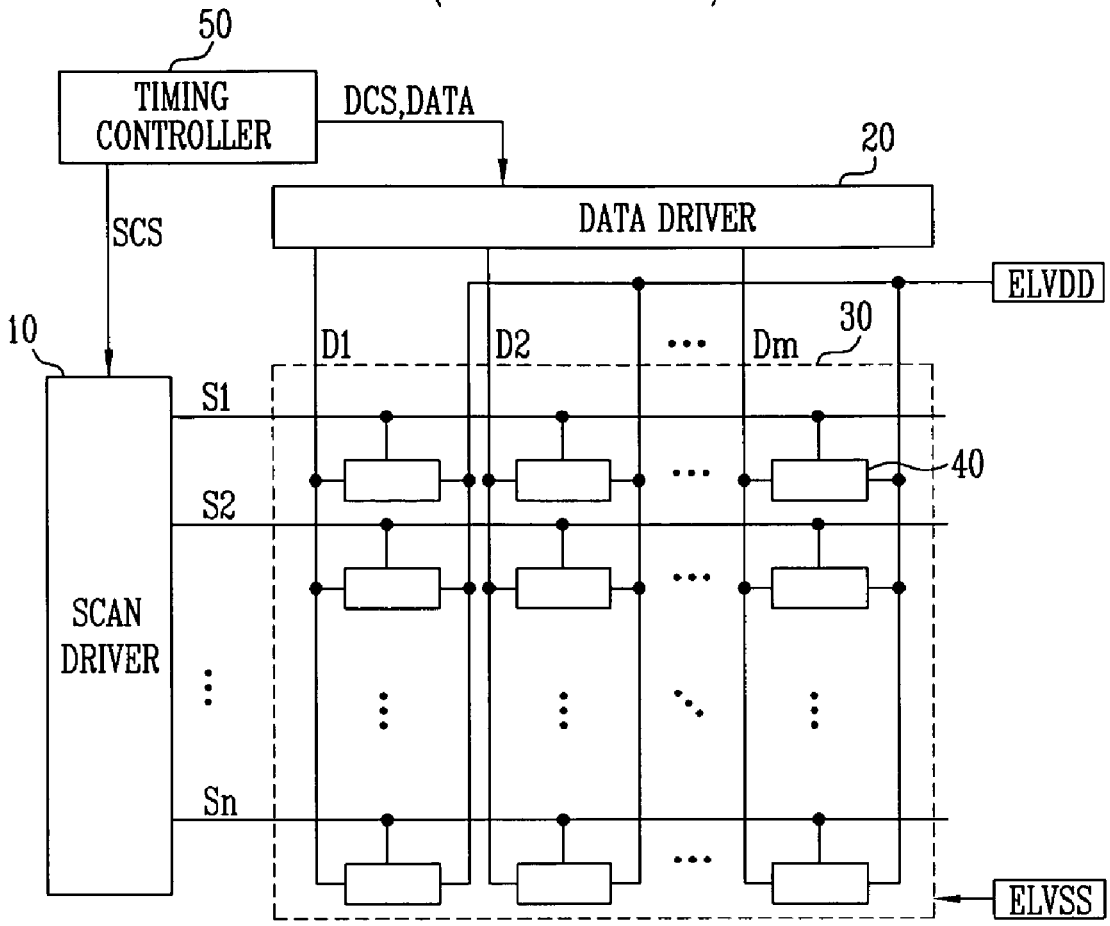
FIG. 1 (RELATED ART)
FIG. 1 illustrates a schematic diagram of a known light emitting display.

Korean Patent Application No. 2005-0070438, filed on Aug. 1, 2005, in the Korean Intellectual Property Office, and entitled, "Data Driving Circuit and Driving Method of Organic Light Emitting Display Using the Same," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

Hereinafter, exemplary embodiments of the present invention will be described with reference to FIGS. 2 to 11. In data driving circuits, data driving methods and light emitting displays employing one or more aspects of the invention, because a voltage of a data signal is reset using a compensation voltage generated when current sinks from a respective pixel, uniform images can be displayed regardless of electron mobility, threshold voltages, etc. of transistors.

Figure 2:
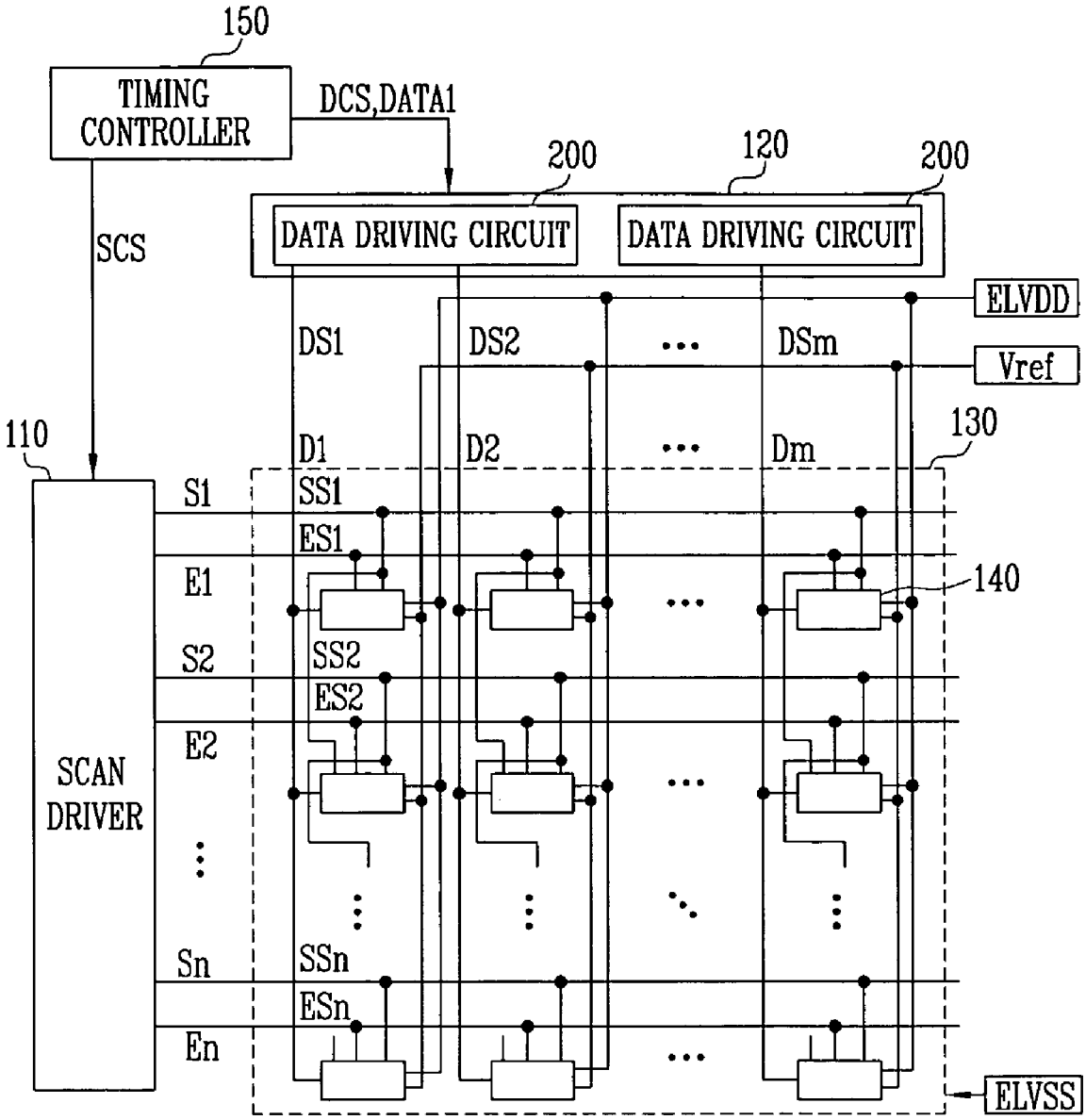
FIG. 2 illustrates a schematic diagram of a light emitting display according to an embodiment of the present invention.

FIG. 2 illustrates a schematic diagram of a light emitting display according to an embodiment of the present invention.

As shown in FIG. 2, the light emitting display may include a scan driver 110, a data driver 120, a pixel unit 130 and a timing controller 150. The pixel unit 130 may include a plurality of pixels 140. The pixel unit 130 may include n×m pixels 140 arranged, for example, in n rows and m columns, where n and m may each be integers. The pixels 140 may be connected to scan lines S1 to Sn, emission control lines E1 to En and data lines D1 to Dm. The pixels 140 may be respectively formed in the regions partitioned by the emission control lines En1 to En and the data lines D1 to Dm. The scan driver 110 may drive the scan lines S1 to Sn and the emission control lines E1 to En. The data driver 120 may drive the data lines D1 to Dm. The timing controller 150 may control the scan driver 110 and the data driver 120. The data driver 120 may include one or more data driving circuits 200.

The timing controller 150 may generate data driving control signals DCS and scan driving control signals SCS in response to externally supplied synchronizing signals (not shown). The data driving control signals DCS generated by the timing controller 150 may be supplied to the data driver 120. The scan driving control signals SCS generated by the timing controller 150 may be supplied to the scan driver 110.

The timing controller 150 may supply first data DATA1 to the data driver 120 in accordance with the externally supplied data (not shown).

The scan driver 110 may receive the scan driving control signals SCS from the timing controller 150. The scan driver 110 may generate scan signals SS1 to SSn based on the received scan driving control signals SCS and may sequentially and respectively supply the scan signals SS1 to SSn to the scan lines S1 to Sn. The scan driver 110 may sequentially supply emission control signals ES1 to ESn to the emission control lines E1 to En. Each of the emission control signals ES1 to ESn may be supplied, e.g., changed from a low voltage signal to a high voltage signal, such that an "on" emission control signal, e.g., a high voltage signal, at least partially overlaps at least two of the scan signals SS1 to SSn. Therefore, in embodiments of the invention, a pulse width of the emission control signals ES1 to ESn may be equal to or larger than a pulse width of the scan signals SS1 to SSn.

The data driver 120 may receive the data driving control signals DCS from the timing controller 150. The data driver 120 may generate data signals DS1 to DSm based on the received data driving control signals DCS and the first data DATA1. The generated data signals DS1 to DSm may be supplied to the data lines D1 to Dm in synchronization with the scan signals SS1 to SSn supplied to the scan lines S1 to Sn. For example, when the $1^{st}$ scan signal SS1 is supplied, the generated data signals DS1 to DSm corresponding to the pixels 140(1)(1 to m) may be synchronously supplied to the $1^{st}$ to the m-th pixels in the $1^{st}$ row via the data lines D1 to Dm, and when the nth scan signal SSn is supplied, the generated data signals DS1 to DSm corresponding to the pixels 140(*n*)(1 to m) may be synchronously supplied to the $1^{st}$ to the m-th pixels in the n-th row via the data lines D1 to Dm.

The data driver 120 may supply predetermined currents to the data lines D1 to Dm during a first period of one horizontal period 1H for driving one or more of the pixels 140. For example, one horizontal period 1H may correspond to a complete period associated with one of the scan signals SS1 to SSn and a corresponding one of the data signals DS1 to DSm being supplied to the respective pixel 140 in order to drive the respective pixel 140. The data driver 120 may supply predetermined voltages to the data lines D1 to Dm during a second period of the one horizontal period. For example, one horizontal period 1H may correspond to a complete period associated with one of the scan signals SS1 to SSn and a corresponding one of the data signals DS1 to DSm being supplied to the respective pixel 140 in order to drive the respective pixel 140. In embodiments of the invention, the data driver 120 may include at least one data driving circuit 200 for supplying such predetermined currents and predetermined voltages during the first and second periods of one horizontal period 1H. In the following description, the predetermined voltages that may be supplied to the data lines D1 to Dm during the second period will be referred to as the data signals DS1 to DSm.

The pixel unit 130 may be connected to a first power source ELVDD for supplying a first voltage VDD, a second power source ELVSS for supplying a second voltage VSS and a reference power source ELVref for supplying a reference voltage Vref to the pixels 140. The first power source ELVDD, the second power source ELVSS and the reference power source ELVref may be externally provided. The pixels 140 may receive the first voltage VDD signal and the second voltage VSS signal, and may control the currents that flow through respective light emitting devices/materials, e.g., OLEDs, in accordance with the data signals DS1 to DSm that may be supplied by the data driver 120 to the pixels 140. The pixels 140 may thereby generate light components corresponding to the received first data DATA1.

Some or all of the pixels 140 may receive the first voltage VDD signal, the second voltage VSS signal and the reference voltage Vref signal from the respective first, second and reference power sources ELVDD, ELVSS and ELVref. The pixels 140 may compensate for a voltage drop in the first voltage VDD signal and/or threshold voltage(s) using the reference voltage Vref signal. The amount of compensation may be based on a difference between voltage values of the reference voltage Vref signal and the first voltage VDD signal respectively supplied by the reference power source ELVref and the first power source ELVDD. The pixels 140 may supply respective currents from the first power source ELVDD to the second power source ELVSS via, e.g., the OLEDs in response to the respective data signals DS1 to DSm. In embodiments of the invention, each of the pixels 140 may have, for example, the structure illustrated in FIG. 3 or 5.

Figure 3:
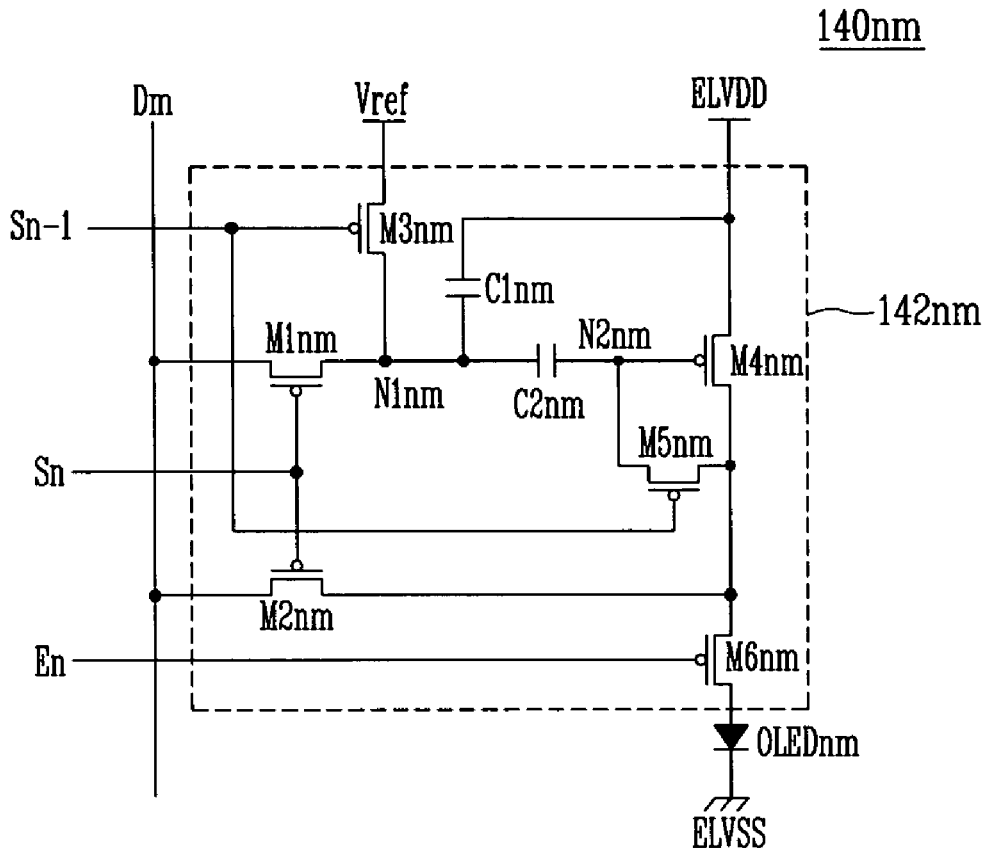
FIG. 3 illustrates a circuit diagram of an exemplary pixel employable in the light emitting display illustrated in FIG. 2.

FIG. 3 illustrates a circuit diagram of an nm-th exemplary pixel 140*nm* employable in the light emitting display illustrated in FIG. 2. For simplicity, FIG. 3 illustrates the nm-th pixel that may be the pixel provided at the intersection of the n-th row of scan lines Sn and the m-th row of data lines Dm. The nm-th pixel 140*nm* may be connected to the m-th data line Dm, the n−1th and nth scan lines Sn−1 and Sn and the nth emission control line En. For simplicity, FIG. 3 only illustrates one exemplary pixel 140*nm*. In embodiments of the invention, the structure of the exemplary pixel 140*nm* may be employed for all or some of the pixels 140 of the light emitting display.

Referring to FIG. 3, the nm-th pixel 140*nm* may include a light emitting material/device, e.g., OLEDnm, and an nm-th pixel circuit 142*nm* for supplying current to the associated light emitting material/device.

The nm-th OLEDnm may generate light of a predetermined color in response to the current supplied from the nm-th pixel circuit 142*nm*. The nm-th OLEDnm may be formed of, e.g., organic material, phosphor material and/or inorganic material.

In embodiments of the invention, the nm-th pixel circuit 142*nm* may generate a compensation voltage for compensating for variations within and/or among the pixels 140 such that the pixels 140 may display images with uniform brightness. The nm-th pixel circuit 142*nm* may generate the compensation voltage using a previously supplied scan signal of the scan signals SS1 to SSn during each scan cycle. In embodiments of the invention, one scan cycle may correspond to scan signals SS1 to SSn being sequentially supplied. Thus, in embodiments of the invention, during each cycle, the n−1th scan signal SSn−1 may be supplied prior to the nth scan signal SSn and when the n−1th scan signal SSn−1 is being supplied to the n−1th scan line of the light emitting display, the nm-th pixel circuit 142*nm* may employ the n−1th scan signal SSn−1 to generate a compensation voltage. For example, the second pixel in the second column, i.e., the pixel $\mathbf{140}_{22}$, may generate a compensation voltage using the first scan signal SS1.

The compensation voltage may compensate for a voltage drop in a source voltage signal and/or a voltage drop resulting from a threshold voltage of the transistor of the nm-th pixel circuit 142*nm*. For example, the nm-th pixel circuit 142*nm* may compensate for a voltage drop of the first voltage VDD signal and/or a threshold voltage of a transistor, e.g., a threshold voltage of a fourth transistor M4*nm* of the pixel circuit 142*nm* based on the compensation voltage that may be generated using a previously supplied scan line during the same scan cycle.

In embodiments of the invention, the pixel circuit 142*nm* may compensate for a drop in the voltage of the first power source ELVDD and the threshold voltage of the fourth transistor M4*nm* when the n−1th scan signal SSn−1 is supplied to the n−1th scan line Sn−1, and may charge the voltage corresponding to the data signal DSm when the nth scan signal SSn is supplied to the nth scan line Sn. In embodiments of the invention, the pixel circuit 142*nm* may include first to sixth transistors M1*nm* to M6*nm*, a first capacitor C1*nm* and a second capacitor C2*nm* to generate the compensation voltage and to drive the light emitting material/device.

A first electrode of the first transistor M1*nm* may be connected to the data line Dm and a second electrode of the first transistor M1*nm* may be connected to a first node N1*nm*. A gate electrode of the first transistor M1*nm* may be connected to the nth scan line Sn. The first transistor M1*nm* may be turned on when the nth scan signal SSn is supplied to the nth scan line Sn. When the first transistor M1*nm* is turned on, the data line Dm may be electrically connected to the first node N1*nm*.

A first electrode of the first capacitor C1*nm* may be connected to the first node N1*nm* and a second electrode of the first capacitor C1*nm* may be connected to the first power source ELVDD.

A first electrode of the second transistor M2*nm* may be connected to the data line Dm and a second electrode of the second transistor M2*nm* may be connected to a second electrode of the fourth transistor M4*nm*. A gate electrode of a second transistor M2*nm* may be connected to the nth scan line Sn. The second transistor M2*nm* may be turned on when the nth scan signal SSn is supplied to the nth scan line Sn. When the second transistor M2*nm* is turned on, the data line Dm may be electrically connected to the second electrode of the fourth transistor M4*nm*.

A first electrode of the third transistor M3*nm* may be connected to the reference power source ELVref and a second electrode of the third transistor M3*nm* may be connected to the first node N1*nm*. A gate electrode of the third transistor M3*nm* may be connected to the n−1th scan line Sn−1. The third transistor M3*nm* may be turned on when the n−1th scan signal SSn−1 is supplied to the n−1th scan line Sn−1. When the third transistor M3*nm* is turned on, the reference voltage Vref may be electrically connected to the first node N1*nm*.

A first electrode of the fourth transistor M4*nm* may be connected to the first power source ELVDD and the second electrode of the fourth transistor M4*nm* may be connected to a first electrode of the sixth transistor M6*nm*. A gate electrode of the fourth transistor M4*nm* may be connected to the second node N2*nm*.

A first electrode of the second capacitor C2*nm* may be connected to the first node N1*nm* and a second electrode of the second capacitor C2*nm* may be connected to the second node N2*nm*.

In embodiments of the invention, the first and second capacitors C1*nm* and C2*nm* may be charged when the n−1th scan signal SSn−1 is supplied. In particular, the first and second capacitors C1*nm* and C2*nm* may be charged and the fourth transistor M4*nm* may supply a current corresponding to a voltage at the second node N2*nm* to the first electrode of the sixth transistor M6*nm*.

A second electrode of the fifth transistor M5*nm* may be connected to the second node N2*nm* and a first electrode of the fifth transistor M5*nm* may be connected to the second electrode of the fourth transistor M4*nm*. A gate electrode of the fifth transistor M5*nm* may be connected to the n−1th scan line Sn−1. The fifth transistor M5*nm* may be turned on when the n−1th scan signal SSn−1 is supplied to the n−1th scan line Sn−1 so that current flows through the fourth transistor M4*nm*. Therefore, the fourth transistor M4*nm* may operate as a diode.

The first electrode of the sixth transistor M6*nm* may be connected to the second electrode of the fourth transistor M4*nm* and a second electrode of the sixth transistor M6*nm* may be connected to an anode electrode of the nm-th OLEDnm. A gate electrode of the sixth transistor M6*nm* may be connected to the nth emission control line En. The sixth transistor M6*nm* may be turned off when an emission control signal ESn is supplied, e.g., a high voltage signal, to the nth emission control line En and may be turned on when no emission control signal, e.g., a low voltage signal, is supplied to the nth emission control line En.

In embodiments of the invention, the emission control signal ESn supplied to the nth emission control line En may be supplied to at least partially overlap both the n−1th scan signal SSn−1 that may be supplied to the n−1th scan line Sn−1 and the nth scan signal SSn that may be supplied to nth scan line Sn. Therefore, the sixth transistor M6*nm* may be turned off when the n−1th scan signal SSn−1 is supplied, e.g., a low voltage signal is supplied, to the n−1th scan line Sn−1 and the n-th scan signal SSn is supplied, e.g., a low voltage signal is supplied, to the nth scan line Sn so that a predetermined voltage may be charged in the first and second capacitors C1*nm* and C2*nm*. The sixth transistor M6*nm* may be turned on during other times to electrically connect the fourth transistor M4*nm* and the nm-th OLEDnm to each other. In the exemplary embodiment shown in FIG. 3, the transistors M1*nm* to M6*nm* are PMOS transistors, which may turn on when a low voltage signal is supplied to the respective gate electrode and may turn on when a high voltage signal is supplied to the respective gate electrode. However, the present invention is not limited to PMOS devices.

In the pixel illustrated in FIG. 3, because the reference power source ELVref does not supply current to the pixels 140, a drop in the voltage of the reference voltage Vref may not occur. Therefore, it is possible to maintain the voltage value of the reference voltage Vref signal uniform regardless of the positions of the pixels 140. In embodiments of the invention, the voltage value of the reference voltage Vref may be equal to or different from the first voltage ELVDD.

Figure 4:
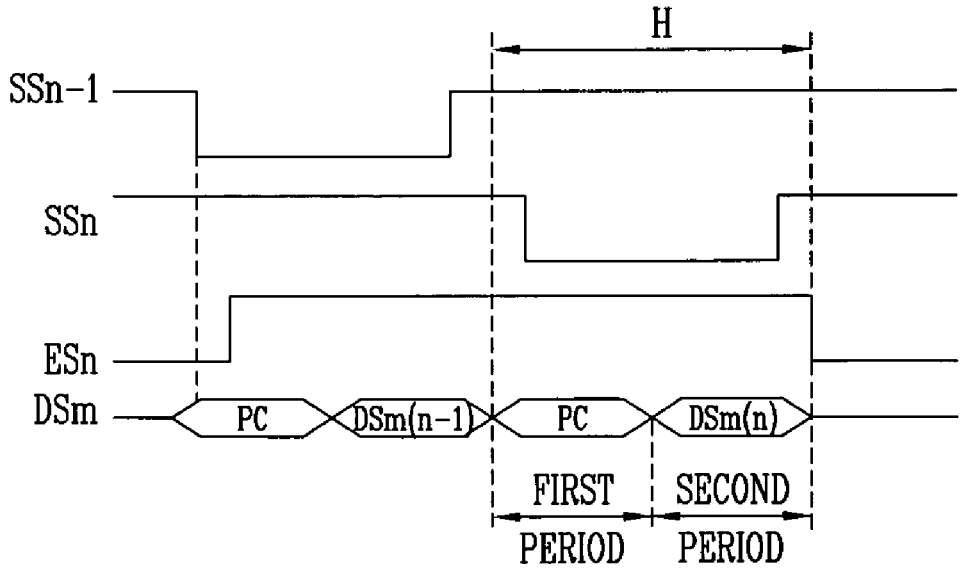
FIG. 4 illustrates exemplary waveforms employable for driving the pixel illustrated in FIG. 3.

FIG. 4 illustrates exemplary waveforms that may be employed for driving the exemplary nm-th pixel 140*nm* illustrated in FIG. 3. As shown in FIG. 4, each horizontal period 1H for driving the nm-th pixel 140*nm* may be divided into a first period and a second period. During the first period, predetermined currents (PCs) may respectively flow through the data lines D1 to Dm. During the second period, the data signals DS1 to DSm may be supplied to the respective pixels 140 via the data lines D1 to Dm. During the first period, the respective PCs may be supplied from each of the pixel(s) 140 to a data driving circuit 200 that may be capable of functioning, at least in part, as a current sink. During the second period, the data signals DS1 to DSm may be supplied from the data driving circuit 200 to the pixel(s) 140. For simplicity, in the following description, it will be assumed that, at least initially, i.e., prior to any voltage drop that may result during operation of the pixels 140, the voltage value of the reference voltage Vref signal is equal to the voltage value of the first voltage VDD signal.

Exemplary methods of operating the nm-th pixel circuit 142*nm* of the nm-th pixel 140*nm* of the pixels 140 will be described in detail with reference to FIGS. 3 and 4. First, the n−1th scan signal SSn−1 may be supplied to the n−1th scan line Sn−1 to control the on/off operation of the m pixels that may be connected to the n−1th scan line Sn−1. When the scan signal SSn−1 is supplied to the n−1th scan line Sn−1, the third and fifth transistors M3*nm* and M5*nm* of the nm-th pixel circuit 142*nm* of the nm pixel 140*nm* may be turned on. When the fifth transistor M5*nm* is turned on, current may flow through the fourth transistor M4*nm* so that the fourth transistor M4*nm* may operate as a diode. When the fourth transistor M4*nm* operates as a diode, the voltage value of the second node N2*nm* may correspond to a difference between the threshold voltage of the fourth transistor M4*nm* and the voltage of the first voltage VDD signal being supplied by the first power source ELVDD.

More particularly, when the third transistor M3*nm* is turned on, the reference voltage Vref signal from the reference power source ELVref may be applied to the first node N1*nm*. The second capacitor C2*nm* may be charged with a voltage corresponding to the difference between the first node N1*nm* and the second node N2*nm*. In embodiments of the invention in which the reference voltage Vref signal from the reference power source ELVref and the first voltage VDD from the first power source ELVDD may, at least initially, i.e., prior to any voltage drop that may result during operation of the pixels 140, be equal, the voltage corresponding to the threshold voltage of the fourth transistor M4*nm* may be charged in the second capacitor C2*nm*. In embodiments of the invention in which a predetermined drop in voltage of the first voltage VDD signal occurs, the threshold voltage of the fourth transistor M4*nm* and a voltage corresponding to the magnitude of the voltage drop of the first power source ELVDD may be charged in the second capacitor C2*nm*.

In embodiments of the invention, during the period where the n−1th scan signal SSn−1 may be supplied to the n−1th scan line Sn−1, a predetermined voltage corresponding to the sum of the voltage corresponding to the voltage drop of the first voltage VDD signal and the threshold voltage of the fourth transistor M4*nm* may be charged in the second capacitor C2*nm*. By storing the voltage corresponding to a sum of the voltage drop of the first voltage VDD signal from the first power source ELVDD and the threshold voltage of the fourth transistor M4*nm* during operation of the respective n−1 pixel of in the m-th column, it is possible to later utilize the stored voltage to compensate for both the voltage drop of the first voltage VDD signal and the threshold voltage during operation of the respective nm-th pixel 140*nm*.

In embodiments of the invention, the voltage corresponding to the sum of the threshold voltage of the fourth transistor M4*nm* and the difference between the reference voltage signal Vref and the first voltage VDD signal may be charged in the second capacitor C2*nm* before the nth scan signal SSn is supplied to the nth scan line Sn. When the nth scan signal SSn is supplied to the nth scan line Sn, the first and second transistors M1*nm* and M2*nm* may be turned on. During the first period of one horizontal period, when the second transistor M2*nm* of the pixel circuit 142*nm* of the nm-th pixel 140*nm* is turned on, the PC may be supplied from the nm-th pixel 140*nm* to the data driving circuit 200 via the data line Dm. In embodiments of the invention, the PC may be supplied to the data driving circuit 200 via the first power source ELVDD, the fourth transistor M4*nm*, the second transistor M2*nm* and the data line Dm. A predetermined voltage may then be charged in the first and second capacitors C1*nm* and C2*nm* in response to the supplied PC.

The data driving circuit 200 may reset a voltage of a gamma voltage unit (not shown) based on a predetermined voltage value, i.e., compensation voltage that may be generated when the PC sinks, as described above. The reset voltage from the gamma voltage unit (not shown) may be used to generate the data signals DS1 to DSm to be respectively supplied to the data lines D1 to Dm.

In embodiments of the invention, the generated data signals DS1 to DSm may be respectively supplied to the respective data lines D1 to Dm during the second period of the one horizontal period. More particularly, e.g., the respective generated data signal DSm may be supplied to the respective first node N1*nm* via the first transistor M1*nm* during the second period of the one horizontal period. Then, the voltage corresponding to difference between the data signal DSm and the first power source ELVDD may be charged in the first capacitor C1*nm*. The second node N2*nm* may then float and the second capacitor C2*nm* may maintain the previously charged voltage.

In embodiments of the invention, during the period when the n−1 pixel in the m-th column is being controlled and the scan signal SSn−1 is being supplied to the previous scan line Sn−1, a voltage corresponding to the threshold voltage of the fourth transistor M4*nm* and the voltage drop of the first voltage VDD signal from the first power source ELVDD may be charged in the second capacitor C2*nm* of the nm-th pixel 140*nm* to compensate for the voltage drop of the first voltage VDD signal from the first power source ELVDD and the threshold voltage of the fourth transistor M4*nm*.

In embodiments of the invention, during the period when the n-th scan signal SSn is supplied to the n-th scan line Sn, the voltage of the gamma voltage unit (not shown) may be reset so that the electron mobility of the transistors included in the respective n-th pixels 140*n* associated with each data line D1 to Dm may be compensated for and the respective generated data signals DS1 to DSm may be supplied to the n-th pixels 140*n* using the respective reset gamma voltages. Therefore, in embodiments of the invention, non-uniformity in the threshold voltages of the transistors and the electron mobility may be compensated, and images with uniform brightness may be displayed. Processes for resetting the voltage of the gamma voltage unit will be described below.

Figure 5:
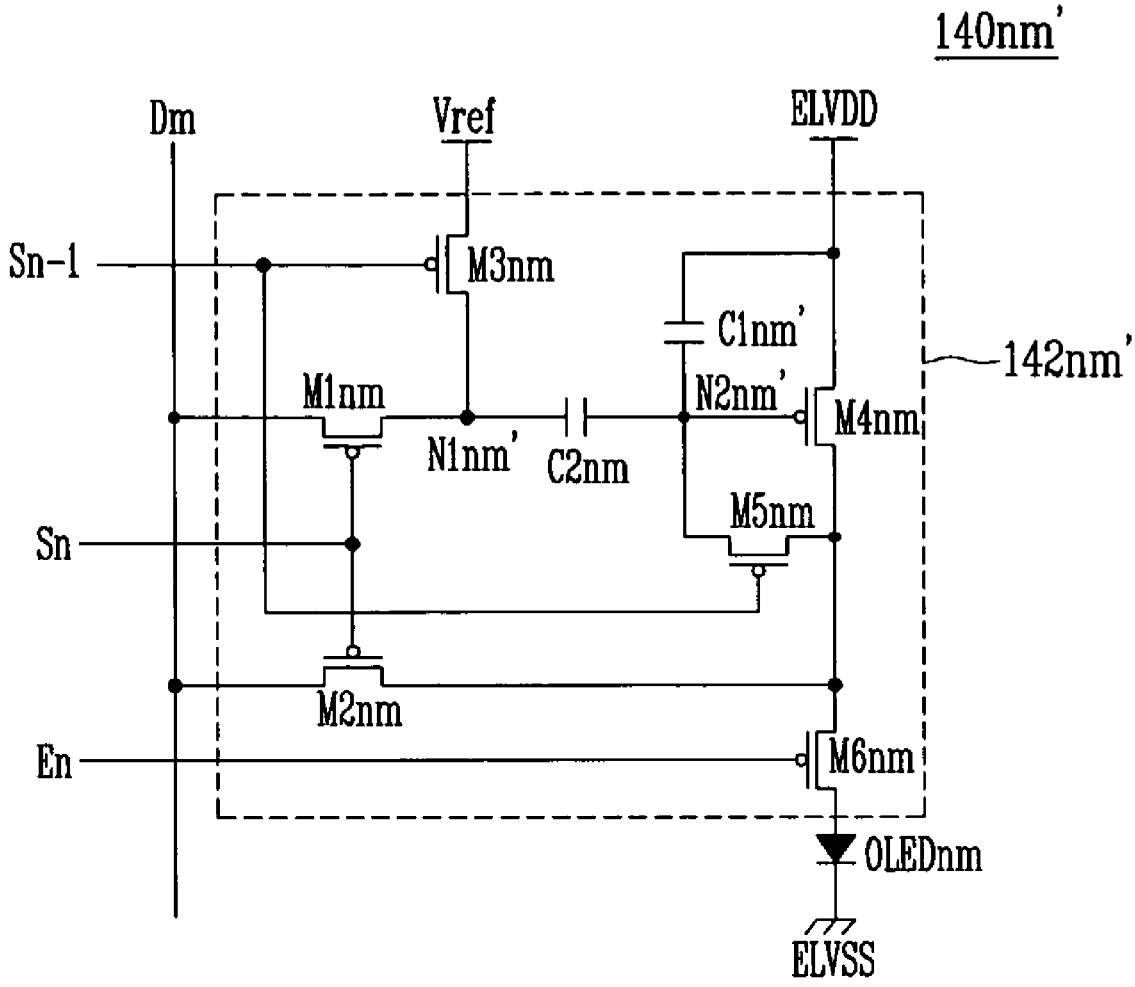
FIG. 5 illustrates a circuit diagram of another exemplary pixel employable in the light emitting display illustrated in FIG. 2.

FIG. 5 illustrates another exemplary embodiment of an nm-th pixel 140*nm*' employable by the light emitting display illustrated in FIG. 2. The structure of the nm-th pixel 140*nm*' illustrated in FIG. 5 is substantially the same as the structure of the nm-th pixel 140*nm* illustrated in FIG. 3, but for the arrangement of a first capacitor C1*nm*' in a pixel circuit 142*nm*' and respective connections to a first node N1*nm*' and a second node N2*nm*'. In the exemplary embodiment illustrated in FIG. 5, a first electrode of the first capacitor C1*nm*' may be connected to the second node N2*nm*' and a second electrode of the first capacitor C1*nm*' may be connected to the first power source ELVDD. A first electrode of the second capacitor C2*nm* may be connected to the first node N1*nm*' and a second electrode of the second capacitor C2*nm* may be connected to the second node N2*nm*'. The first node N1*nm*' may be connected to the second electrode of the first transistor M1*nm*, the second electrode of the third transistor M3*nm* and the first electrode of the second capacitor C2*nm*. The second node N2*nm*' may be connected to the gate electrode of the fourth transistor M4*nm*, the second electrode of the fifth transistor M5*nm*, the first electrode of the first capacitor C1*nm*' and the second electrode of the second capacitor C2*nm*.

In the following description, the same reference numerals employed above in the description of the nm-th pixel 140*nm* shown in FIG. 3 will be employed to describe like features in the exemplary embodiment of the nm-th pixel 140*nm*' illustrated in FIG. 5.

Exemplary methods for operating the nm-th pixel circuit 142*nm*' of the nm-th pixel 140*nm*' of the pixels 140 will be described in detail with reference to FIGS. 4 and 5. First, during a horizontal period for driving the n−1 pixels 140(*n*−1)(1 to m), i.e., the pixels arranged in the (n−1)th row, when the n−1th scan signal SSn−1 is supplied to the n−1th scan line Sn−1, the third and fifth transistors M3*nm* and M5*nm* of the n-th pixel(s) 140(*n*)(1 to m), i.e., the pixels arranged in the n-th row, may be turned on.

When the fifth transistor M5*nm* is turned on, current may flow through the fourth transistor M4*nm* so that the fourth transistor M4*nm* may operate as a diode. When the fourth transistor M4*nm* operates as a diode, a voltage corresponding to a value obtained by subtracting the threshold voltage of the fourth transistor M4*nm* from the first power source ELVDD may be applied to a second node N2*nm*'. The voltage corresponding to the threshold voltage of the fourth transistor M4*nm* may be charged in the first capacitor C1*nm*'. As shown in FIG. 5, the first capacitor C1*nm*' may be provided between the second node N2*nm*' and the first power source ELVDD.

When the third transistor M3*nm* is turned on, the voltage of the reference power source ELVref may be applied to the first node N1*nm*'. Then, the second capacitor C2*nm* may be charged with the voltage corresponding to difference between a first node N1*nm*' and the second node N2*nm*'. During the period where the n−1th scan signal SSn−1 is supplied to the n−1th scan line Sn−1 and the first and second transistors M1*nm* and M2*nm* may be turned off, the data signal DSm may not be supplied to the nm-th pixel 140*nm'*.

Then, during the first period of the one horizontal period for driving the nm-th pixel 140*nm*', the scan signal SSn may be supplied to the nth scan line Sn and the first and second transistors M1*nm* and M2*nm* may be turned on. When the second transistor M2*nm* is turned on, during the first period of the one horizontal period, the respective PC may be supplied from the nm-th pixel 140*nm*' to the data driving circuit 200 via the data line Dm. The PC may be supplied to the data driving circuit 200 via the first power source ELVDD, the fourth transistor M4*nm*, the second transistor M2*nm* and the data line Dm. In response to the PC, predetermined voltage may be charged in the first and second capacitors C1*nm*' and C2*nm*.

The data driving circuit 200 may reset the voltage of the gamma voltage unit using the compensation voltage applied in response to the PC to generate the data signal DS using the respectively reset voltage of the gamma voltage unit.

Then, during the second period of the one horizontal period for driving the nm-th pixel 140*nm*', the data signal DSm may be supplied to the first node N1*nm*'. The predetermined voltage corresponding to the data signal DSm may be charged in the first and second capacitors C1*nm*' and C2*nm*.

When the data signal DSm is supplied, the voltage of the first node N1*nm*' may fall from the voltage Vref of the reference power source ELVref to the voltage of the data signal DSm. At this time, as the second node N2*nm*' may be floating, the voltage value of the second node N2*nm*' may be reduced in response to the amount of voltage drop of the first node N1*nm*'. The amount of reduction in voltage that may occur at the second node N2*nm*' may be determined by the capacitances of the first and second capacitors C1*nm*' and C2*nm*.

When the voltage of the second node N2*nm*' falls, the predetermined voltage corresponding to the voltage value of the second node N2*nm*' may be charged in the first capacitor C1*nm*'. When the voltage value of the reference power source ELVref is fixed, the amount of voltage charged in the first capacitor C1*nm*' may be determined by the data signal DSm. That is, in the nm-th pixel 140*nm*' illustrated in FIG. 5, because the voltage values charged in the capacitors C1*nm*' and C2*nm* may be determined by the reference power source ELVref and the data signal DSm, it may be possible to charge a desired voltage irrespective of the voltage drop of the first power source ELVDD.

In embodiments of the invention, the voltage of the gamma voltage unit may be reset so that the electron mobility of the transistors included in each of the pixels 140 may be compensated for and the respective generated data signal may be supplied using the reset gamma voltage. In embodiments of the invention, non-uniformity among the threshold voltages of the transistors and deviation in the electron mobility of the transistors may be compensated for, thereby enabling images with uniform brightness to be displayed.

Figure 6:
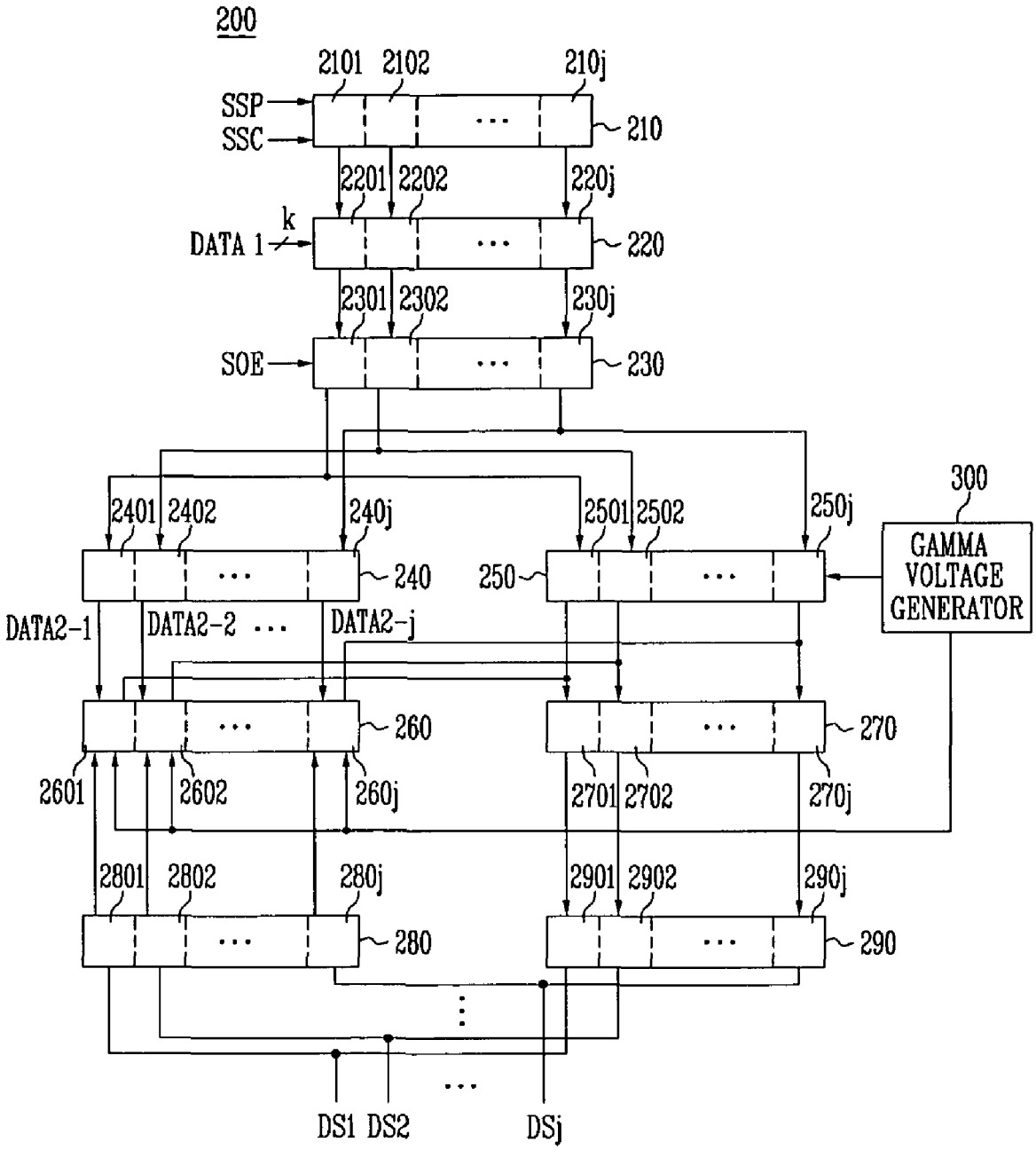
FIG. 6 illustrates a block diagram of a first embodiment of the data driving circuit illustrated in FIG. 2.

FIG. 6 illustrates a block diagram of a first exemplary embodiment of the data driving circuit illustrated in FIG. 2. For simplicity, in FIG. 6, it is assumed that the data driving circuit 200 has j channels, where j is a natural number equal to or greater than 2.

As shown in FIG. 6, the data driving circuit 200 may include a shift register unit 210, a sampling latch unit 220, a holding latch unit 230, a decoder unit 240, a digital-analog converter unit (hereinafter, referred to as a a DAC) 250, a voltage controller unit 260, a first buffer unit 270, a current supply unit 280, a selector 290 and a gamma voltage unit 300.

The shift register unit 210 may receive a source shift clock SSC and a source start pulse SSP from the timing controller 150. The shift register unit 210 may utilize the source shift clock SSC and the source start pulse SSP to sequentially generate j sampling signals while shifting the source start pulse SSP every one period of the source shift clock SSC. The shift register unit 210 may include j shift registers 2101 to 210*j*.

The sampling latch unit 220 may sequentially store the respective first data DATA1 in response to sampling signals sequentially supplied from the shift register unit 210. The sampling latch unit 220 may include j sampling latches 2201 to 220*j* in order to respectively store the j first data DATA1-1 to DATA1-*j*. Each of the sampling latches 2201 to 220*j* may have a magnitude corresponding to a number of bits of the first data DATA1. For example, when the first data DATA1 is k bits, each of the sampling latches 2201 to 220*j* may have a magnitude of k bits such that the sampling latches 2201 to 220*j* may respectively store k-bits of each of the j first DATA1-1 to DATA1-*j*.

The holding latch unit 230 may receive the first data DATA1 from the sampling latch unit 220 to store the first data DATA1 when a source output enable SOE signal is input to the holding latch unit 230. The holding latch unit 230 may supply the first data DATA1 stored therein to the decoder unit 240 and/or the DAC unit 250 when the SOE signal is input. The holding latch unit 230 may include j holding latches 2301 to 230*j* in order to store the j first data DATA1-1 to DATA1-*j*. Each of the holding latches 2301 to 230*j* may have a magnitude corresponding to the number of bits of the first data DATA1. For example, each of the holding latches 2301 to 230*j* may have a magnitude of k bits so that the k bits of each of the j first data DATA1-1 to DATA1-*j* may be respectively stored.

The decoder unit 240 may include j decoders 2401 through 240*j*. Each of the decoders 2401 through 240*j* may receive k bits of the respective first data DATA1 and may convert the k bits of the first data DATA1 into p (p is a natural number) bits of second data DATA2. In embodiments of the invention, each of the decoders 2401 through 240*j* may generate p bits of second data DATA2 using a binary weighted value.

In embodiments of the invention, the weighted value of the externally received first data DATA1 may be determined to allow the gamma voltage unit 300 to be set a predetermined voltage. For example, the number of bits of the first data DATA1 allowing a desired gray scale voltage to be selected from a plurality of gray scale voltages may be determined. The plurality of gray scale voltages may be generated by the gamma voltage unit 300. The decoders 2401 through 240*j* may convert k bits of the first data DATA1, corresponding to the gray scale voltages, into respective p bits of second data DATA2-1 to DATA2-*j* using a binary weighted value. For example, the decoders 2401 through 240*j* may generate five bits of the second data DATA2 using eight bits of the first data DATA1.

The current supply unit 280 may sink predetermined current PC from the respective pixel(s) 140 selected by one of the scan signals SS1 to SSn. The current supply unit 280 may receive the sinking current via the respective one of the data lines D1 through Dj, during the first period of each horizontal period.

In embodiments of the invention, the current supply unit 280 may sink an amount of current corresponding to a minimum amount of current that may be employed by the respective light emitter, e.g., OLED, to emit light of maximum brightness. Then, the current supply unit 280 may supply a predetermined compensation voltage to the voltage controller unit 260. The compensation voltage may be generated while the respective predetermined current PC was sinking. In the exemplary embodiment illustrated in FIG. 6, the current supply unit 280 includes j current sink units 2801 through 280*j*.

Figure 8:
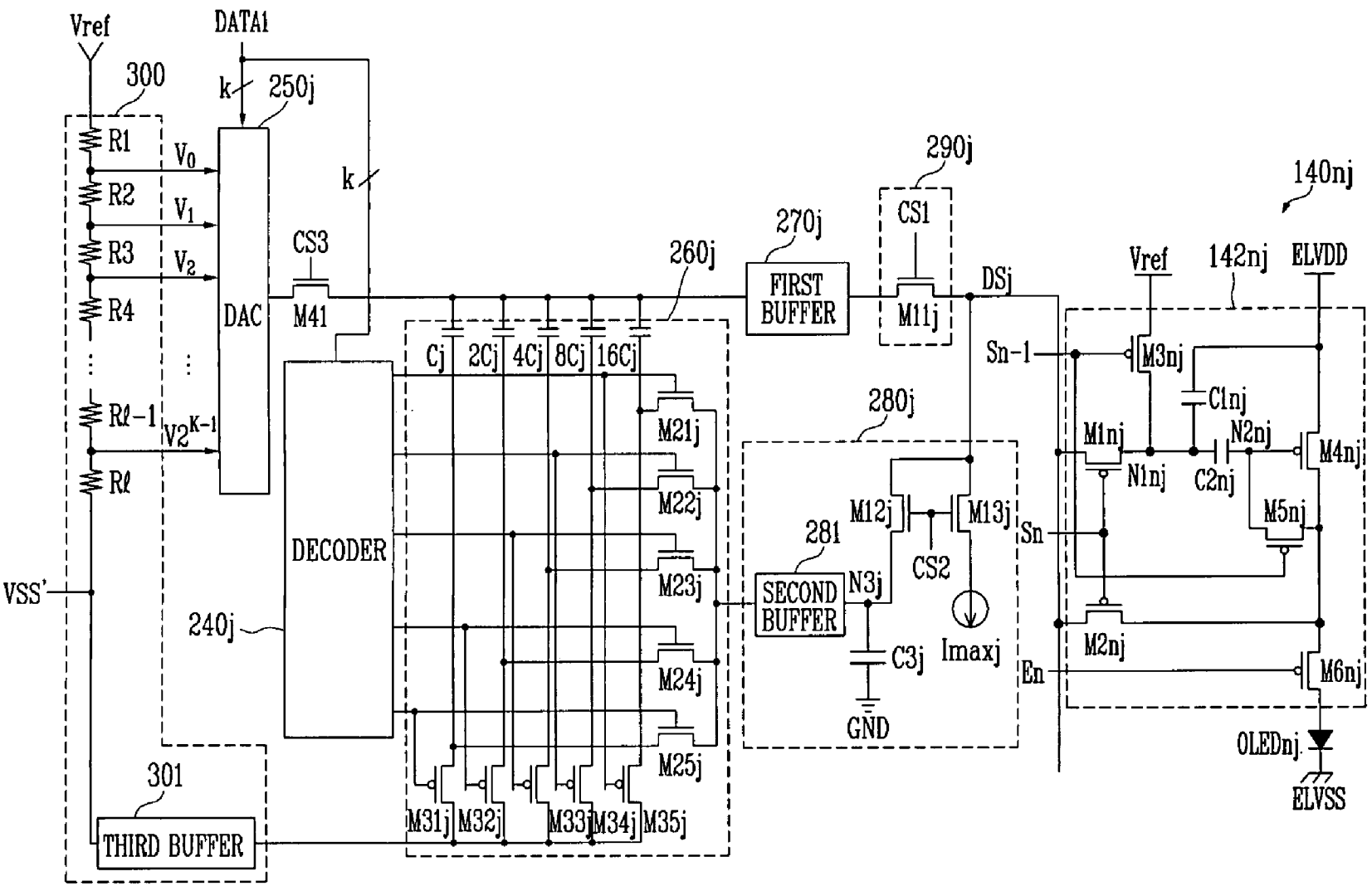
FIG. 8 illustrates a schematic diagram of a first embodiment of a connection scheme connecting a gamma voltage unit, a digital-to-analog converter, a decoder, a voltage controller, a switching unit and a current sink unit illustrated in FIG. 6, and a pixel illustrated in FIG. 3.

The gamma voltage unit 300 may generate predetermined gray scale voltages corresponding to the k bits of the first data DATA1. The gamma voltage unit 300, as shown in FIG. 8, may include a plurality of distribution or voltage dividing resistors R1 through R/ and may generate $2^k$ gray scale voltages. The gray scale voltages generated by the gamma voltage unit 300 may be supplied to the DAC unit 250.

The DAC unit 250 may include j DACs 2501 through 250*j*. The gray scale voltages generated by the gamma voltage unit 300 may be supplied to each of the j DACs 2501 through 250*j*. Each of the DACs 2501 through 250*j* may select, as a data signal DS, one of the gray scale voltages that may be supplied by the gamma voltage unit 300 based on the respective first data DATA1-1 to DATA1-*j* supplied from the respective holding latch units 2301 through 230*j*. For example, the DACs 2501 to 250*j* may respectively select, as a data signal DS, one of the gray scale voltages that may be supplied by the gamma voltage unit 300 based on a number of bits of the respective first data DATA1-1 to DATA1-*j*.

The voltage controller unit 260 may include j voltage controllers 2601 through 260*j*.

The voltage controllers 2601 through 260*j* may each receive a compensation voltage, e.g., voltage supplied via the respective current sink unit 2801-280*j* or the second data DATA2, and a third supply voltage signal VSS'. In embodiments of the invention, a same power source or a different power source may be employed for supplying the second voltage VSS signal and the third supply voltage VSS' signal. The third supply voltage VSS' signal may be supplied to a terminal of the gamma voltage unit 300. The voltage controllers 2601 through 260*j*, which may receive the compensation voltage and/or the second data DATA2, and the third supply voltage VSS' signal, may control a voltage value of the selected data signal DS so that variations among the pixels 140, such as, variations due to electron mobility, threshold voltage, etc. of transistors included in the respective pixels 140 may be compensated for.

The first buffer unit 270 may supply the respective data signal DS to the selector 290. As discussed above, the voltage of the respective data signal may be controlled by the voltage control unit 260. In embodiments of the invention, the first buffer unit 270 may include j first buffers 2701 through 270*j*.

The selector 290 may control electrical connections between the data lines D1 to Dj and the first buffers 2701 to 270*j*. The selector 290 may electrically connect the data lines D1 to Dj and the first buffers 2701 to 270*j* to each other during the second period of the one horizontal period. In embodiments of the invention, the selector 290 may electrically connect the data lines D1 to Dj and the first buffers 2701 to 270*j* to each other only during the second period. During periods other than the second period, the selector 290 may keep the data lines D1 to Dj and the first buffers 2701 to 270*j* electrically disconnected from each other.

Figure 10:
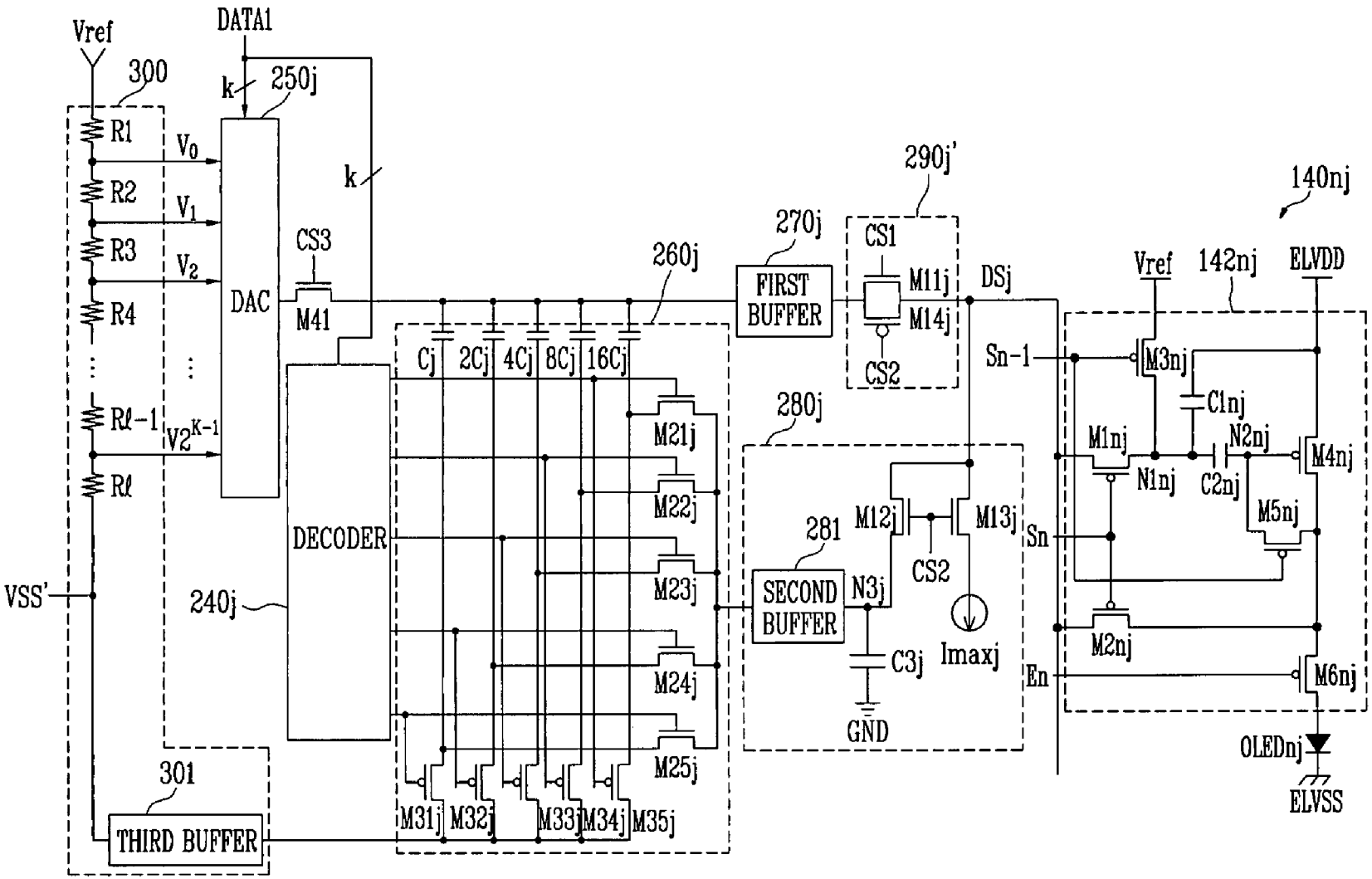
FIG. 10 illustrates the connection scheme illustrated in FIG. 8 employing another embodiment of a switching unit.

The selector 290 may include j switching units 2901 to 290*j*. The generated respective data signals DS1 to DSj may be respectively supplied from the first buffers 2701 to 270*j* to the data lines D1 to Dj via the switching units 2901 to 290*j*. In embodiments of the invention, the selection unit 290 may employ other types of switching units. FIG. 10 illustrates another exemplary embodiment of a switching unit switching unit 290*j*' that may be employed by the selector 290.

Figure 7:
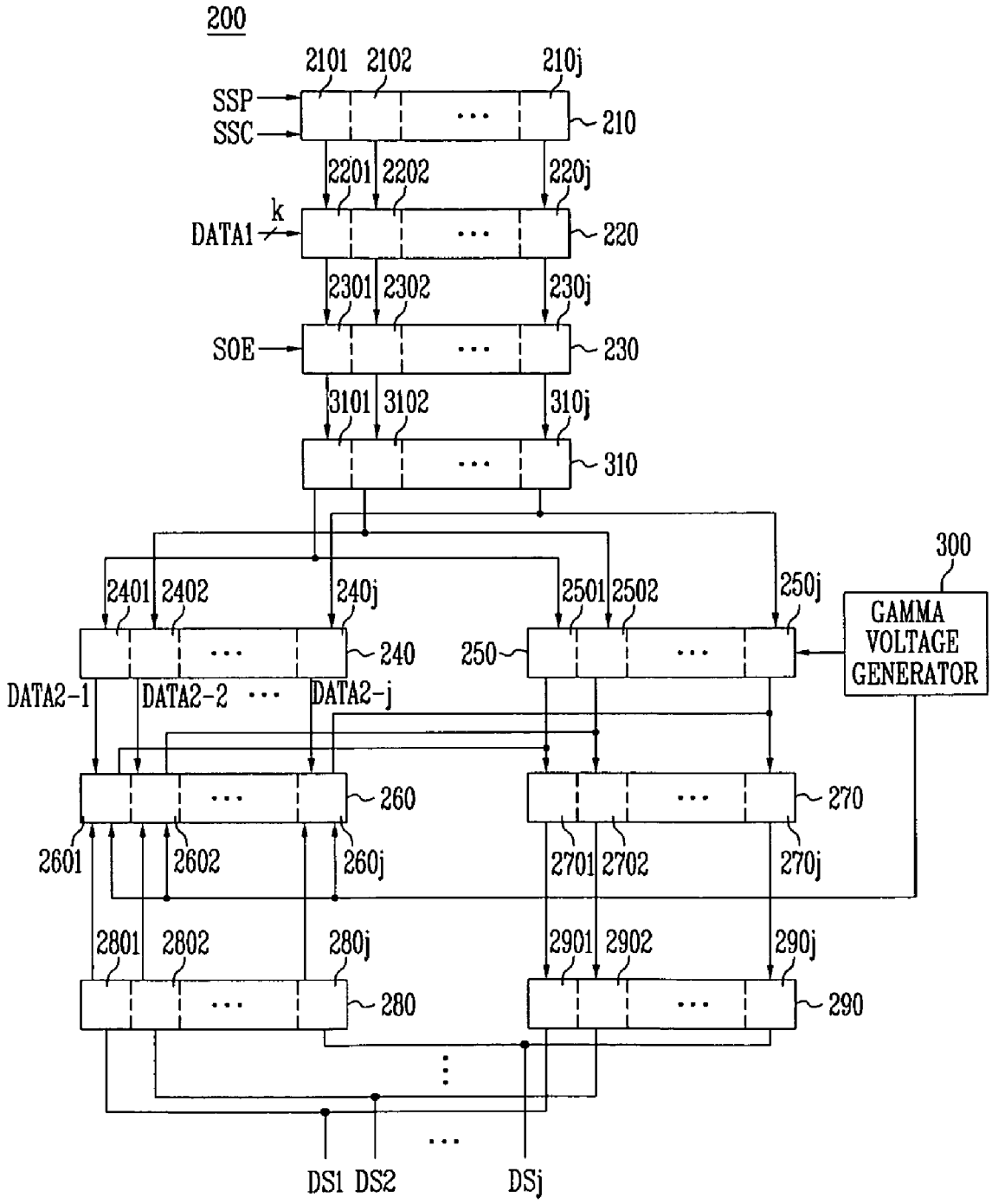
FIG. 7 illustrates a block diagram of a second embodiment of the data driving circuit illustrated in FIG. 2.

As shown in FIG. 7, in a second exemplary embodiment, the data driving circuit 200 may include a level shifter 310 that is connected to the holding latch unit 230. The level shifter 310 may include level registers 3101 to 310*j* and may raise the voltage of the first data DATA1 that may be supplied from the holding latch unit 230 and may supply the level-shifted result to the DAC unit 250 and the decoder unit 240. When the data (not shown) being supplied from an external system to the data driving circuit 200 has high voltage levels, circuit components with high voltage resistant properties should generally be provided, thus, increasing the manufacturing cost. In embodiments of the invention, the data being supplied from an external system to the data driving circuit 200 may have low voltage levels and the low voltage level may be transitioned to a high voltage level by the level shifter 310.

FIG. 8 illustrates a first embodiment of a connection scheme for connecting the gamma voltage unit 300, the DAC 250*j*, the decoder 240*j*, the voltage controller 260*j*, the switching unit 290*j*, the current sink unit 280*j*, and a pixel 140*nj*. For simplicity, FIG. 8 only illustrates one channel, i.e., the jth channel and it is assumed that the data line Dj is connected to an nj-th pixel 140*nj* according to the exemplary embodiment of the pixel 140*nm* illustrated in FIG. 3.

As shown in FIG. 8, the gamma voltage unit 300 may include a plurality of distribution resistors R1 to R/. The distribution resistors R1 to R/ may be disposed between the reference supply voltage Vref and the third supply voltage VSS'. The distribution resistors R1 to R/ may distribute or divide a voltage supplied thereto. For example, the distribution resistors R1 to R/ may distribute or divide a voltage between the reference supply voltage Vref and the third supply voltage VSS', and may generate a plurality of gray scale voltages V0 through $V2^K-1$. The distribution resistors R1 to R/ may supply the generated gray scale voltages V0 through $V2^K-1$ to the DAC 250*j*. The gamma voltage unit 300 may supply the third supply voltage VSS' to the voltage controller 260*j* via a third buffer 301.

The DAC 250*j* may select, as a data signal DS, one of the gray scale voltages V0 through $V2^K-1$, based on a number of the bits of the first data DATA1 and may supply the selected voltage to a first buffer 270*j*.

As shown in FIG. 8, a transistor, e.g., forty-first transistor M41, which may be controlled by a third control signal CS3, may be disposed between the DAC 250*j* and the first buffer 270*j*. In such embodiments, the forty-first transistor M41 may be turned on at a predetermined time during the first period of the horizontal period for driving the pixel 140*nj* and the forty-first transistor M41 may supply the data signal DSj supplied from the DAC 250 to the first buffer 270*j*. More particularly, for example, the third control signal CS3 may rise after a second control signal CS2, which will be described below, and may fall at the same time as the second control signal CS2.

The current sink unit 280*j* may include a twelfth transistor M12*j* and a thirteenth transistor M13*j*, a current source Imaxj, a third capacitor C3*j*, a third node N3*j*, a ground voltage source GND and a second buffer 281. The twelfth transistor M12*j* and the thirteenth transistor M13*j* may be controlled by the second control signal CS2. The current source Imaxj may be connected to a first electrode of the thirteenth transistor M13*j*. The third capacitor C3*j* may be connected between the third node N3*j* and the ground voltage source GND. The second buffer 281*j* may be connected between the third node N3*j* and the voltage controller 260*j*.

A gate electrode of the twelfth transistor M12*j* may be connected to a gate electrode of the thirteenth transistor M13*j*. A second electrode of the twelfth transistor M12*j* may be connected to a second electrode of the thirteenth transistor M13*j* and the data line Dj. A first electrode of the twelfth transistor M12*j* may be connected to the second buffer 281. The twelfth transistor M12*j* and the thirteenth transistor M13*j* may be turned on during the first period of each horizontal period 1H. The twelfth transistor M12*j* and the thirteenth transistor M13*j* may be turned off during the second period of the horizontal period 1H. The second control signal CS2 may control the on/off state of the twelfth transistor M12*j* and the thirteenth transistor M13*j*.

During the first period of one horizontal period 1H, the current source Imaxj may receive, from the pixel 140*nj*, at least a minimum amount of current that may be supplied to the light emitter, e.g., OLEDnj, for the pixel 140*nj* to emit light with maximum brightness. As discussed above, the second control signal CS2 may control the twelfth transistor M12*j* and the thirteenth transistor M13*j* to be on during the first period, thereby allowing the predetermined current PC to flow from the pixel 140*nj* to the current sink unit 280*j*.

The third capacitor C3*j* may store a compensation voltage that may be applied to the third node N3*j* when the current from the pixel 140*nj* sinks to the current source Imaxj. The third capacitor C3*j* may store the compensation voltage applied to the third node N3*j* during the first period of one horizontal period 1H, and may maintain the compensation voltage at the third node N3*j* stable even when the twelfth transistor M13 and the thirteenth transistor M13 are turned off.

The second buffer 281*j* may transfer the compensation voltage applied to the third node N3*j* to the voltage controller 260*j*.

The decoder 240*j* may receive and may convert k bits of the first data DATA1 into p bits of second data DATA2 using a binary weighted value. The decoder 240*j* may supply an initialization signal (not shown) to the voltage controller 260*j* during the first period of the horizontal period 1H and the decoder 240*j* may supply the p bits of second data DATA2 to the voltage controller 260*j* during the second period of the same horizontal period 1H. In the following description of exemplary embodiments, for simplicity, it will be assumed that the p bits are 5 bits. In embodiments of the invention, p may be any integer greater than or equal to zero.

The voltage controller 260*j* may receive the compensation voltage and/or the second data DATA2, and the third supply voltage VSS' and may control the voltage value of the data signal DSj. In the description of exemplary embodiments, reference term "p" will be equal to five, however, "p" may be any integer. To control the voltage value of the data signal DSj, the voltage controller 260*j* may include p capacitors Cj, 2Cj, 4Cj, 8Cj and 16Cj, p PMOS transistors M31*j*, M32*j*, M33*j*, M34*j* and M35*j* and p NMOS transistors M21*j*, M22*j*, M23*j*, M24*j* and M25*j*. The capacitors Cj, 2Cj, 4Cj, 8Cj and 16Cj may be connected to an electrical path connecting the forty-first transistor M41 and the first buffer 270*j*. The p PMOS transistors M31*j*, M32*j*, M33*j*, M34*j* and M35*j* may be connected the third buffer 301 and the p capacitors Cj, 2Cj, 4Cj, 8Cj and 16Cj, respectively. The p NMOS transistors M21*j*, M22*j*, M23*j*, M24*j* and M25*j* may be connected between the second buffer 281*j* and the p capacitors Cj, 2Cj, 4Cj, 8Cj and 16Cj, respectively.

Capacitance values of the p capacitors Cj, 2Cj, 4Cj, 8Cj and 16Cj may be relative to each other such that the capacitances of the p capacitors may increase along the order of $2^0$, $2^1$, $2^2$, $2^3$ and $2^4$, respectively. For example, the capacitances of the p capacitors Cj, 2Cj, 4Cj, 8Cj and 16Cj may have respective binary weighted values in accordance with the second data DATA2.

The p PMOS transistors M31*j*, M32*j*, M33*j*, M34*j* and M35*j* may be respectively disposed between the p capacitors Cj, 2Cj, 4Cj, 8Cj and 16Cj and the third buffer 301. The p PMOS transistors M31*j*, M32*j*, M33*j*, M34*j* and M35*j* may be turned on when the initialization signal (not shown) is supplied from the decoder 240*j*, and the p PMOS transistors M31*j*, M32*j*, M33*j*, M34*j* and M35*j* may respectively set a voltage of a terminal of the p capacitors Cj, 2Cj, 4Cj, 8Cj and 16Cj to the third supply voltage VSS'.

The p NMOS transistors M21*j*, M22*j*, M23*j*, M24*j* and M25*j* may be respectively disposed between each of the p capacitors Cj, 2Cj, 4Cj, 8Cj and 16Cj and the second buffer 281*j*. The p NMOS transistors M21*j*, M22*j*, M23*j*, M24*j* and M25*j* may be turned on or off during the second period of one horizontal period 1H for driving the pixel 140*nj* based on the second data DATA2 generated from the decoder 240*j*. The p NMOS transistors M21*j*, M22*j*, M23*j*, M24*j* and M25*j* may be controlled to select the respective one/ones of the p capacitors Cj, 2Cj, 4Cj, 8Cj and 16Cj based on bit weighted values of the second data DATA2. For example, if the bits of the second data DATA2 generated by the decoder 240*j* are set to "00011", the twenty-fourth transistor M24*j* and the twenty-fifth transistor M25 are turned on to apply the compensation voltage, e.g., voltage stored in the third capacitor C3*j*, to terminals of the respective first and second ones, e.g., Cj and 2Cj, of the p capacitors. In such embodiments, if bits corresponding to $2^0$ and $2^1$ have a value "1", the on/off state of the p NMOS transistors M21*j*, M22*j*, M23*j*, M24*j* and M25*j* may be controlled so that a compensation voltage may be applied to respective terminals of the first and second ones Cj and 2Cj of the p capacitors Cj, 2Cj, 4Cj, 8Cj and 16Cj. As discussed above, in embodiments of the invention, the first and second ones Cj and 2Cj of the p capacitors Cj, 2Cj, 4Cj, 8Cj and 16Cj, may have capacitances corresponding to $2^0$ and $2^1$.

In embodiments of the invention, the voltage value of the data signal DSj applied to the electrical path between the forty-first transistor M41*j* and the first buffer 270*j* may be increased or decreased in accordance with the compensation voltage that may be applied to respective terminals of the p capacitors Cj, 2Cj, 4Cj, 8Cj and 16Cj. More particularly, any increase or decrease in the voltage value of the data signal DSj applied to the electrical path between the forty-first transistor M41*j* and the first buffer 270*j* (and later to the data line Dj) may depend on the voltage value of the compensation voltage. Because the voltage value of the data signal DSj may be controlled with the applied compensation voltage, the voltage value of the data signal DSj may be controlled so that variations among the pixels 140 may be compensated for and the pixel unit 130 can display a uniform image.

For example, because the voltage value of the data signal DSj may be controlled with the applied compensation voltage, variations in electron mobility and/or threshold voltages of transistors included in the pixel 140*nj* may be compensated for. In embodiments of the invention, because the data driving circuit 200 may control the voltage value of the data signals DS using a compensation voltage generated based on characteristics, e.g., electron mobility, threshold voltage, etc., of the respective pixels 140, the data driving circuit may control the voltage value of the respective data signal DS being supplied to the respective pixels 140 and may can compensate for variations in electron mobility of the transistors.

As shown in FIG. 8, the first buffer 270*j* may transfer the data signal DSj applied to the electrical connection between the forty-first transistor M41*j* and the first buffer 270*j* to the switching unit 290*j*.

Figure 9:
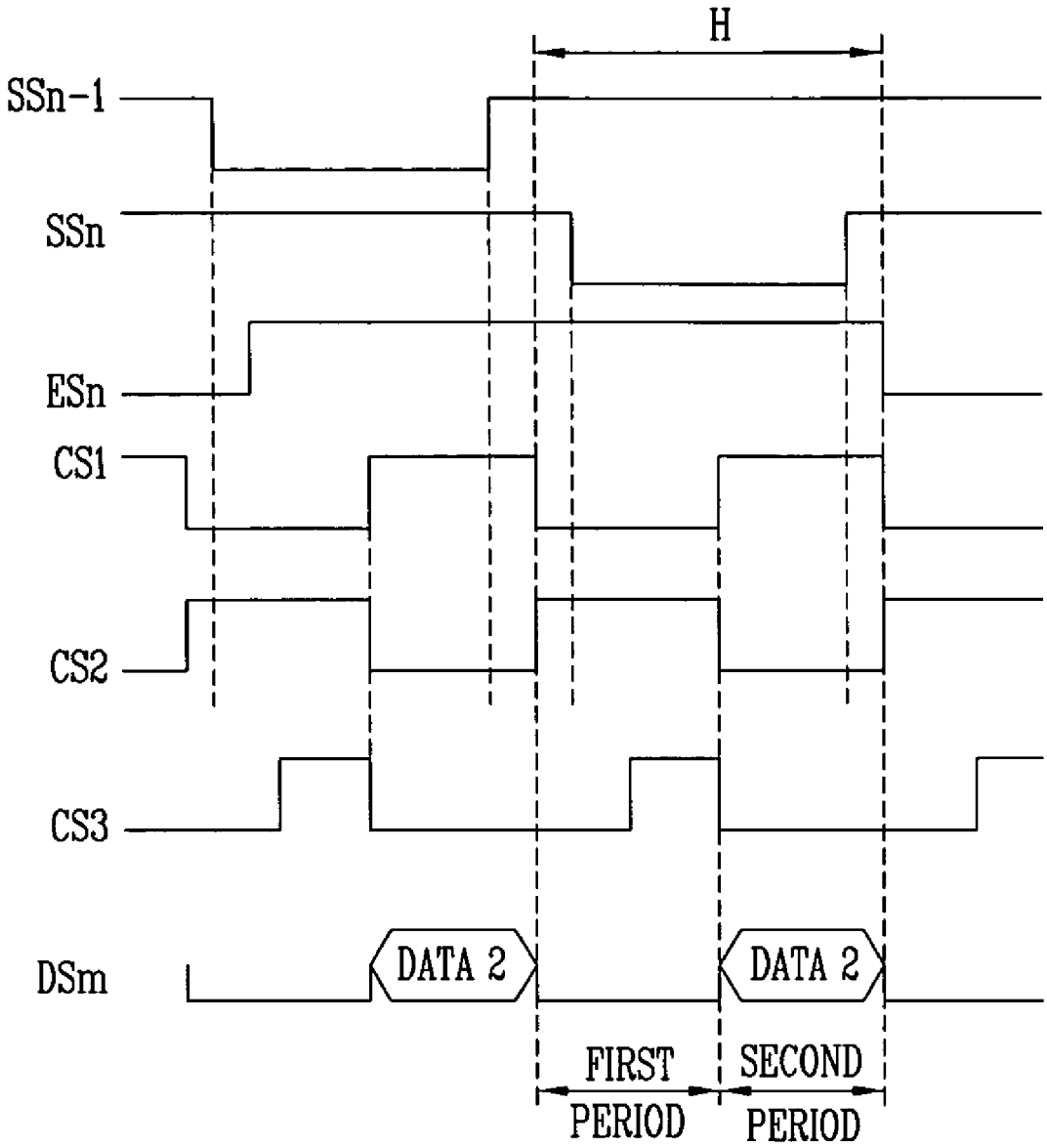
FIG. 9 illustrates exemplary waveforms employable for driving the pixel, the switching unit and the current sink unit illustrated in FIG. 8.

The switching unit 290*j* may include an eleventh transistor M11*j*. The eleventh transistor M11*j* may be controlled by the first control signal CS1, as shown in FIGS. 8 and 9. In embodiments of the invention, the eleventh transistor M11*j* may be turned on during the second period of each horizontal period 1H for driving each of the n pixels in the j-th channel. In such embodiments, the eleventh transistor M11*j* may be turned off during the first period of each horizontal period 1H for driving each of the n pixels in the j-th channel. Thus, the data signal DSj may supplied to the data line Dj during the second period of the horizontal period 1H and may not be supplied during other periods, e.g., the first period, of a single horizontal period 1H. In embodiments of the invention, the data signal DSj may only be supplied during the second horizontal period of a single horizontal period 1H. In embodiments of the invention, the data signal DSj may never be supplied to the data line Dj during the first period of a single horizontal period 1H.

FIG. 9 illustrates exemplary waveforms employable for driving the pixel, the switching unit and the current sink unit illustrated in FIG. 8. Exemplary methods for controlling the voltage of data signals DS respectively supplied to the pixels 140 will be described in detail with reference to FIGS. 8 and 9. In the exemplary embodiment illustrated in FIG. 8, the pixel 140*nj* and the pixel circuit 142*nj*, according to the exemplary embodiment illustrated in FIG. 3, is provided. In the following description, the same reference numerals employed above in the description of the nm-th pixel 140*nm* shown in FIG. 3 will be employed to describe like features in the exemplary embodiment of the nj-th pixel 140*nj* illustrated in FIG. 8.

First, the scan signal SSn−1 may be supplied to the n−1th scan line Sn−1. When the scan signal SSn−1 is supplied to the n−1th scan line Sn−1, the third and fifth transistors M3*nj* and M5*nj* may be turned on. The voltage value obtained by subtracting the threshold voltage of the fourth transistor M4*nj* from the first power source ELVDD may then be applied to a second node N2*nj* and the voltage of the reference power source ELVref may be applied to a first node N1*nj*. The voltage corresponding to the voltage drop of the first power source ELVDD and the threshold voltage of the fourth transistor M4*nj* may then be charged in the second capacitor C2*nj*.

The voltages applied to the first node N1*nj* and the second node N2*nj* may be represented by EQUATION1 and EQUATION2.

$$V_{N1}=Vref \quad \text{[EQUATION1]}$$

$$V_{N2}=ELVDD-|V_{thM4}| \quad \text{[EQUATION2]}$$

In EQUATION1 and EQUATION2, $V_{N1}$, $V_{N2}$, and $V_{thM4}$ represent the voltage applied to the first node N1*nj*, the voltage applied to the second node N2*nj*, and the threshold voltage of the fourth transistor M4*nj*, respectively.

From the time when the scan signal SSn−1 is supplied to the n−1th scan line Sn−1 is turned off, e.g., changed from a low voltage signal to a high voltage signal, to the time when the scan signal SSn is supplied, e.g., changed from a high voltage signal to a low voltage signal, to the nth scan line Snj, the first and second nodes N1*nj* and N2*nj* may be floating. Therefore, the voltage value charged in the second capacitor C2*nj* may not change during that time.

The n-th scan signal SSn may then be supplied to the nth scan line Sn so that the first and second transistors M1*nj* and M2*nj* may be turned on. When the scan signal SSn is being supplied to the nth scan line Sn, during the first period of the one horizontal period when the n-th scan line Sn is being driven, the $12^{th}$ and $13^{th}$ transistors M12*j* and M13*j* may be turned on. When the $12^{th}$ and $13^{th}$ transistors M12*j* and M13*j* are turned on, the current that may flow through the current source Imaxj via the first power source ELVDD, the fourth transistor M4*nj*, the second transistor M2*nj*, the data line Dj, and the $13^{th}$ transistor M13*j* may sink.

When current flows through the current source Imaxj via the first power source ELVDD, the fourth transistor M4*nj* and the second transistor M2*nj*, EQUATION3 may apply.

$$Imax=\frac{1}{2}\mu_p C_{ox}\frac{W}{L}(ELVDD-V_{N2}-|V_{thM4}|)^2 \quad \text{[EQUATION3]}$$

In EQUATION3, μ, Cox, W, and L represent the electron mobility, the capacity of an oxide layer, the width of a channel, and the length of a channel, respectively.

The voltage applied to the second node N2*nj* when the current obtained by EQUATION3 flows through the fourth transistor M4*nj* may be represented by EQUATION4.

$$V_{N2}=ELVDD-\sqrt{\frac{2Imax}{\mu_p C_{ox}}\frac{L}{W}}-|V_{thM4}| \quad \text{[EQUATION4]}$$

The voltage applied to the first node N1*nj* may be represented by EQUATION5 by the coupling of the second capacitor C2*nj*.

$$V_{N1}=Vref-\sqrt{\frac{2Imax}{\mu_p C_{ox}}\frac{L}{W}}=V_{N3} \quad \text{[EQUATION5]}$$

In EQUATION5, the voltage $V_{N1}$ may correspond to the voltage applied to the first node N1*nj* and the voltage $V_{N3}$ may correspond to the voltage applied to the third node N3*j*. In embodiments of the invention, when current sinks by the current source Imaxj, a voltage satisfying EQUATION5 may be applied to the third node N3*j*.

As seen in EQUATION5, the voltage applied to the third node N3*j* may be affected by the electron mobility of the transistors included in the pixel 140*nj*, which is supplying current to the current source Imaxj. Therefore, the voltage value applied to the third node N3*j* when the current is being supplied to the current source Imaxj may vary in each of the pixels 140, e.g., when the electron mobility varies in each of the pixels 140.

During the first period of a horizontal period 1H for driving each of the pixels 140, the DAC 250 may select an h-th one of f gray scale voltages based on the first data DATA1 for respective pixels, where h and f are natural numbers. For example, the DAC 250*j* may select the h-th one of f gray scale voltages corresponding to the first data DATA1 for the nj-th pixel 140*nj*. Then, when the forty-first transistor M41 is turned on, the DAC 250*j* together with the voltage controller 260*j* may selectively apply the selected h-th one of the f gray scale voltages, as the data signal DSj, to the electrical connection between the forty-first transistor M41*j* and the first buffer 270*j*. A voltage applied to the electrical connection between the forty-first transistor M41 and the first buffer 270*j* may be expressed by EQUATION6.

$$V_L = Vref - \frac{h}{f}(Vref - VSS) \quad \text{[EQUATION6]}$$

Meanwhile, as discussed above, the decoder 240*j* may supply an initialization signal during the first period of each horizontal period 1H. The initialization signal may turn on the thirty-first transistor M31*j*, the thirty-second transistor M32*j*, the thirty-third transistor M33*j*, the thirty-fourth transistor M34*j* and the thirty-fifth transistor M35*j*. Thus, during the first period of each horizontal period 1H, a voltage of a terminal of each of the p capacitors Cj, 2Cj, 4Cj, 8Cj and 16Cj may be set to a voltage of the third supply voltage VSS'. In embodiments of the invention, the voltage value of the third supply voltage VSS' may be set lower than the voltage value of the reference supply voltage Vref. For example, the third supply voltage VSS' may be set to an average voltage of compensation voltages that may be generated by the pixels 140 included in the pixel unit 130.

After the voltage of the terminal of each of the p capacitors CJ, 2Cj, 4Cj, 8Cj and 16Cj is set to the third supply voltage VSS', during the second period of the horizontal period, a twenty-first transistor M21*j*, a twenty-second transistor M22*j*, a twenty-third transistor M23*j*, a twenty-fourth transistor M24*j* and a twenty-fifth transistor M25*j* may be turned on or off in accordance with the second data DATA2 that may be supplied from the decoder 240*j*. The decoder 240*j* may control the on/off state of the twenty-first transistor M21*j*, the twenty-second transistor M22*j*, the twenty-third transistor M23*j*, the twenty-fourth transistor M24*j*, and the twenty-fifth transistor M25*j*. In particular, the decoder 240*j* may control the on/off state of the twenty-first transistor M21*j*, the twenty-second transistor M22*j*, the twenty-third transistor M23*j*, the twenty-fourth transistor M24*j*, and the twenty-fifth transistor M25*j* to obtain a value approximating to a value of h/f in EQUATION6.

For example, if the bits of the second data DATA2 generated by the decoder 240*j* are set to "00011", the twenty-fourth transistor M24*j* and the twenty-fifth transistor M25*j* may be turned on to apply a compensation voltage to a terminal of each of the first and second ones Cj and 2Cj of the p capacitors. In this example, because the compensation voltage may be applied to a terminal of each of the first and second ones Cj and 2Cj of the p capacitors, EQUATION7 can be deduced.

$$\frac{C + 2C}{C + 2C + 4C + 8C + 16C} \cong \frac{h}{f} \quad \text{[EQUATION7]}$$

More particularly, because the second data DATA2 may be derived from the first data DATA1, a value satisfying EQUATION7 approximates the value of h/f.

Meanwhile, if the compensation voltage is applied to at least one of the p capacitors Cj, 2Cj, 4Cj, 8Cj and 16Cj, a voltage of the electrical connection between the forty-first transistor M41 and the first buffer 270*j* may be expressed by EQUATION8.

$$\begin{aligned} V_L &= Vref - \frac{h}{f}(Vref - VSS) + Vboost \\ Vboost &= \frac{h}{f}(V_{N3} - VSS) \\ &= Vref - \frac{h}{f}(Vref - V_{N3}) \\ &= Vref - \frac{h}{f}\sqrt{\frac{2Imax}{\mu_p C_{OX}}\frac{L}{W}} \end{aligned} \quad \text{[EQUATION8]}$$

A voltage satisfying EQUATION8 may be supplied to the eleventh transistor M11*j* via the first buffer 270*j*. During the second period of the one horizontal period 1H, because the eleventh transistor M11*j* may be turned on, the voltage supplied to the first buffer 270*j* may be supplied to the first node N1*nj* via the eleventh transistor M11*j*, the data line Dj, and the first transistor M1*nj*. The voltage satisfying EQUATION8 may be supplied to the first node N1*nj*. A voltage applied to the second node N2*nj* by coupling of the second capacitor C2*nj* can be expressed by EQUATION9.

$$V_{N2} = ELVDD - \frac{h}{f}\sqrt{\frac{2Imax}{\mu_p C_{OX}}\frac{L}{W}} - |V_{thM4}| \quad \text{[EQUATION9]}$$

Here, current flowing through the fourth transistor M4*nj* may be expressed by EQUATION10.

$$\begin{aligned} I_{N4} &= \frac{1}{2}\mu_p C_{OX}\frac{W}{L}(ELVDD - V_{N2} - |V_{thM4}|)^2 \\ &= \frac{1}{2}\mu_p C_{OX}\frac{W}{L}\left(\begin{array}{c} ELVDD - \\ ELVDD - \\ \left(\frac{h}{f}\sqrt{\frac{2Imax}{\mu_p C_{OX}}\frac{L}{W}} - \right. \\ |V_{thM4}| \\ V_{thM4} \end{array}\right)^2 \\ &= \left(\frac{h}{f}\right)^2 Imax \end{aligned} \quad \text{[EQUATION10]}$$

Referring to EQUATION10, in embodiments of the invention, current flowing through the fourth transistor M4*nj* may depend on the respective data signal DS supplied to the respective pixel 140 and more particularly, the gray scale voltage generated by the voltage controller 260*j*. Therefore, in embodiments of the invention, by supplying a current based on a compensation voltage generated by current sinking from the respective pixel 140*nj*, a desired current may be selected and supplied as the respective data signal DS, irrespective of threshold voltage, electron mobility, etc. of the transistors, e.g., M4*nj*, of the respective pixel. Thus, embodiments of the invention enable uniform images to be displayed irrespective of variations in electron mobility and threshold voltage within and among the pixels 140 of the pixel unit 130.

In embodiments of the invention, as discussed above, different switching units may be employed. FIG. 10 illustrates the connection scheme illustrated in FIG. 8 employing another embodiment of a switching unit 290*j*'. The exemplary connection scheme illustrated in FIG. 10 is substantially the same as the exemplary connection scheme illustrated in FIG. 8, but for another exemplary embodiment of the switching unit 290*j*'. In the following description, the same reference numerals employed above will be employed to describe like features in the exemplary embodiment illustrated in FIG. 10.

As shown in FIG. 10, another exemplary switching unit 290*j*' may include eleventh and fourteenth transistors M11*j*, M14*j* that may be connected to each other in the form of a transmission gate. The 14$^{th}$ transistor M14*j*, which may be a PMOS type transistor, may receive the second control signal CS2. The eleventh transistor M11*j*, which may be a NMOS type transistor, may receive the first control signal CS1. In such embodiments, when the polarity of the first control signal CS1 is opposite to the polarity of the second control signal CS2, the eleventh and fourteenth transistors M11*j* and M14*j* may be turned on and off at the same time.

In embodiments of the invention in which the eleventh and fourteenth transistors M11*j* and M14*j* may be connected to each other in the form of the transmission gate. In such embodiments, a voltage-current characteristic curve may be in the form of a straight line and switching error may be minimized.

Figure 11:
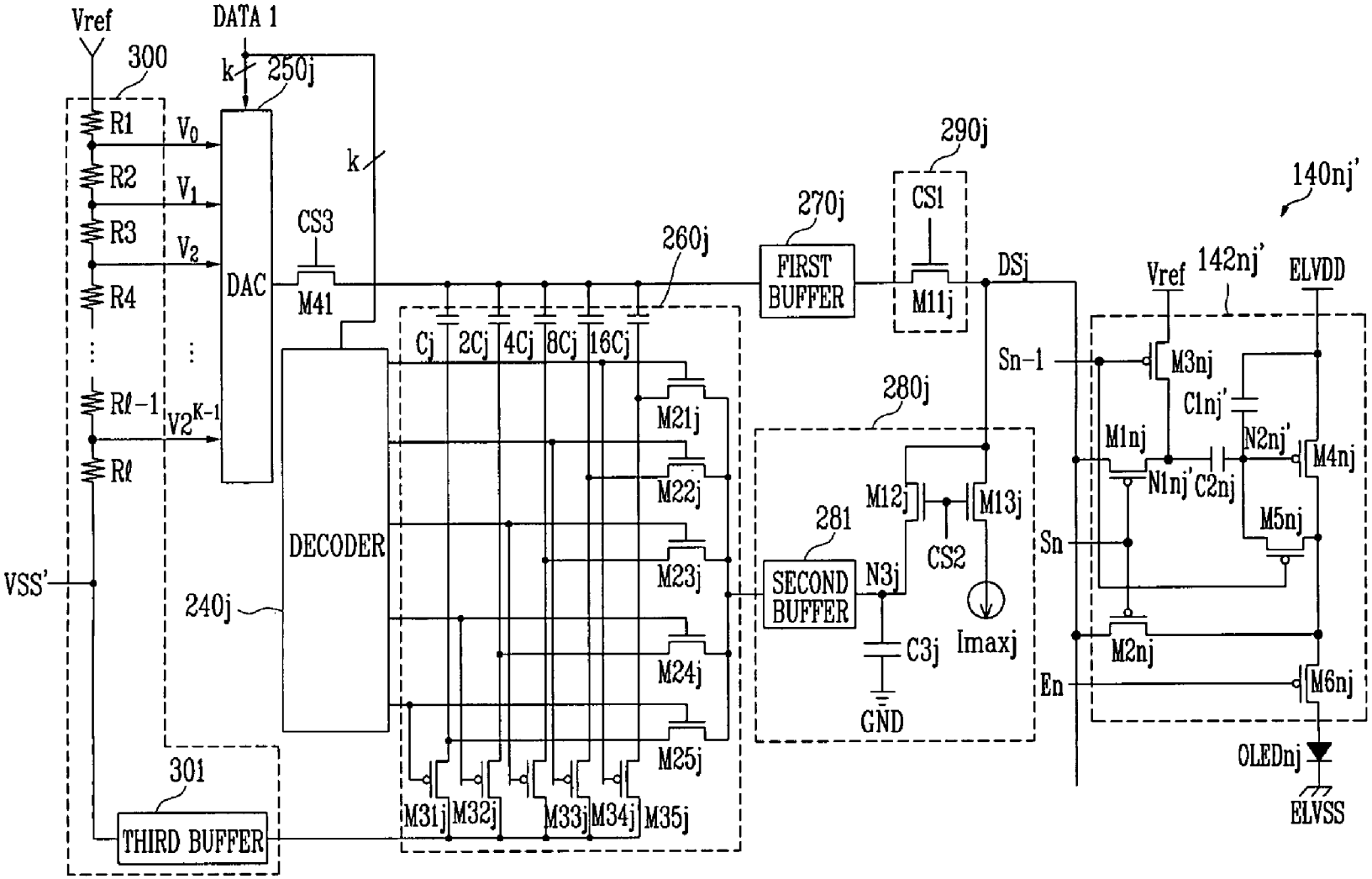
FIG. 11 illustrates a schematic diagram of a second embodiment of a connection scheme connecting the gamma voltage unit, the digital-to-analog converter, the decoder, the voltage controller, the switching unit and the current sink unit illustrated in FIG. 6, and the pixel illustrated in FIG. 5.

FIG. 11 illustrates a second embodiment of a connection scheme for connecting the gamma voltage unit 300, the DAC 250*j*, the decoder 240*j*, the voltage controller 260*j*, the switching unit 290*j*, the current sink unit 280*j*, and a pixel 140*nj*'. For simplicity, FIG. 11 only illustrates one channel, i.e., the jth channel and it is assumed that the data line Dj is connected to the nj-th pixel 140*nj*' according to the exemplary embodiment of the pixel 140*nm*' illustrated in FIG. 5.

Methods for driving pixels 140 of a light emitting display will be described in detail with reference to FIGS. 9 and 11. First, when a scan signal SSn−1 is supplied to the n−1th scan line Sn−1, a voltage satisfying EQUATION1 and EQUATION2 may be applied to a first node N1*nj*' and a second node N2*nj*', respectively.

The n-th scan signal may be applied to the n-th scan line Sn. During the first period of a horizontal period 1H for driving the nj-th pixel 140*nj*', w when the twelfth transistor M12*j* and the thirteenth transistor M13*j* may be turned on, current flowing through the fourth transistor M4*j* may satisfy EQUATION3 and a voltage applied to the second node N2*nj*' may satisfy EQUATION4. In the following description, the same reference numerals employed above in the description of the exemplary embodiment illustrated in FIG. 8 will be employed to describe like features in the exemplary embodiment of the connection scheme illustrated in FIG. 11.

A voltage applied to the first node N1*nj*' by coupling of the second capacitor C2*nj* can be expressed by EQUATION11.

$$V_{N1} = Vref - \left(\frac{C1 + C2}{C2}\right)\sqrt{\frac{2Imax}{\mu_p C_{ox}}\frac{L}{W}} = V_{N3} \quad \text{[EQUATION11]}$$

Meanwhile, during the first period of the horizontal period for driving the nj-th pixel 140*nj*', the DAC 250*j* may select an h-th one of f gray scale voltages in accordance with the first data DATA1, where h and f are natural numbers. The DAC 250*j* may also supply a gray scale voltage satisfying EQUATION6. The selected h-th one of the f gray scale voltages may be supplied to first buffer 270*j* when the forty-first transistor M41 is turned on. The selected h-th one of the f gray scale voltages may be selected, as a respective data signal DSj to be supplied to the pixel 140*nj*' via the data line Dj.

The decoder 240*j* may supply an initialization signal to the thirty-first transistor M31*j*, the thirty-second transistor M32*j*, the thirty-third transistor M33*j*, the thirty-fourth transistor M34*j* and the thirty-fifth transistor M35*j* and may thereby turn on each of the p transistors M31*j*, M32*j*, M33*j*, M34*j* and M35*j* during the first period of the horizontal period 1H for driving the pixel 140*nj*'. Thus, during the first period of the one horizontal period 1H, a voltage of a terminal of each of the p capacitors CJ, 2Cj, 4Cj, 8Cj and 16Cj may be to the third supply voltage VSS'.

Then, during the second period of the horizontal period 1H for driving the pixel 140*nj*', the twenty-first transistor M21*j*, the twenty-second transistor M22*j*, the twenty-third transistor M23*j*, the twenty-fourth transistor M24*j* and the twenty-fifth transistor M25*j* may be turned on or off in accordance with the second data DATA2 that may be supplied from the decoder 240*j*. The decoder 240*j* may control the turning on/off of the twenty-first transistor M21*j*, the twenty-second transistor M22*j*, the twenty-third transistor M23*j*, the twenty-fourth transistor M24*j* and the twenty-fifth transistor M25*j*. In particular, as discussed above, the decoder 240*j* may control the turning on/off of the twenty-first transistor M21*j*, the twenty-second transistor M22*j*, the twenty-third transistor M23*j*, the twenty-fourth transistor M24*j* and the twenty-fifth transistor M25*j* so as to obtain a value approximating to the value of h/f in EQUATION6.

At this time, a voltage $V_L$ of the electrical connection between the forty-first transistor M41 and the first buffer 270*j* may be expressed by EQUATION12.

$$\begin{aligned} V_L &= Vref - \frac{h}{f}(Vref - VSS) + Vboost \\ Vboost &= \frac{h}{f}(V_{N3} - VSS) \\ &= Vref - \frac{h}{f}(Vref - V_{N3}) \\ &= Vref - \frac{h}{f}\left(\frac{C1 + C2}{C2}\right)\sqrt{\frac{2Imax}{\mu_p C_{OX}}\frac{L}{W}} \end{aligned} \quad \text{[EQUATION12]}$$

A voltage satisfying EQUATION12 may be supplied to the eleventh transistor M11*j* via the first buffer 270*j*. During the second period of the horizontal period 1H for driving the pixel 140*nj*', because the eleventh transistor M11*j* may be turned on, the voltage supplied to the first buffer 270*j* may be supplied to the first node N1*nj*' via the eleventh transistor M11*j*, the data line Dj and the first transistor M1*j*. In embodiments of the invention, a voltage satisfying EQUATION12 may be supplied to the first node N1*nj*'.

A voltage applied to the second node N2*nj*' by the coupling of the second capacitor C2*nj* may be expressed by EQUATION9. Accordingly, current flowing through the fourth transistor M4*nj* may be expressed by EQUATION10. In embodiments of the invention, the current corresponding to the gray scale voltage selected by the DAC 250*j* may flow to the fourth transistor M4*nj* irrespective of the threshold voltage and electron mobility of the fourth transistor M4*nj*. As discussed above, embodiments of the invention enable the display of images with uniform brightness.

In some embodiments of the invention, e.g., embodiments employing the pixel 140*nj*' illustrated in FIG. 11, the voltage of the second node N2*nj*' may change gradually although the voltage of the first node N1*nj*' may change rapidly, i.e., (C1+C2)/C2. When the pixel 140*nj*' illustrated in FIG. 11 is employed, a greater voltage range may be set for the voltage generator 240*j* than a voltage range that may be set for the voltage generator 240*j* when the pixel 140*nj* illustrated in FIG. 8 is employed. As discussed above, when the voltage range of the voltage generator 240*j* is set to be larger, it is possible to reduce the influence of the switching error of the $11^{th}$ transistor M11*j* and the first transistor M1*nj*.

Accordingly, the pixel structure 140*nj*' shown in FIG. 5 can extend an available voltage range of the gamma voltage unit 300, compared with the pixel structure 140*nj* shown in FIG. 3. As such, by extending the available voltage range of the gamma voltage unit 300, it is possible to reduce influences by switching errors of the eleventh transistor M11*j*, the first transistor M1*nj*, etc.

As described above, in data driving circuits, data driving methods and light emitting displays employing one or more aspects of the invention, because a voltage of a data signal is reset using a compensation voltage generated when current sinks from a respective pixel, uniform images can be displayed regardless of electron mobility, threshold voltages, etc. of transistors.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A data driving circuit for driving a pixel of a light emitting display based on externally supplied first data for the pixel, wherein the pixel is electrically connectable to the driving circuit via a data line, the data driving circuit comprising:

a gamma voltage unit generating a plurality of gray scale voltages;

a digital-analog converter selecting, as a data signal, one of the plurality of gray scale voltages using k bits of the first data, k being a natural number;

a decoder generating p bits of second data using the k bits of the first data, p being a natural number;

a current sink receiving a predetermined current from the pixel during a first partial period of a complete period for driving the pixel based on the selected gray scale voltage;

a voltage controller controlling a voltage value of the data signal using the second data and a compensation voltage generated based on the predetermined current received by the current sink, the compensation voltage being supplied from the current sink to the voltage controller; and a switching unit supplying the data signal, with the controlled voltage value, to the pixel, the switching unit supplying the data signal during any partial period of the complete period elapsing after the first partial period of the complete period.

2. The data driving circuit as claimed in claim 1, wherein the decoder converts the first data into a binary weighted value to generate the second data.

3. The data driving circuit as claimed in claim 1, further comprising:

a first transistor disposed between the digital-analog converter and the switching unit, the digital-analog converter being turned on during a predetermined time of the first partial period to transfer the data signal, with the controlled voltage value, to the switching unit; and a first buffer connected between the first transistor and the switching unit.

4. The data driving circuit as claimed in claim 3, wherein the gamma voltage unit comprises:

a plurality of distribution resistors for generating the gray scale voltages and distributing a reference supply voltage and a first supply voltage; and a second buffer for supplying the first supply voltage to the voltage controller.

5. The data driving circuit as claimed in claim 4, wherein the voltage controller comprises:

p capacitors, each of the p capacitors having a first terminal that is connected to an electrical path between the a first transistor and the first buffer;

second transistors respectively connected between a second terminal of each of the p capacitors and the a second buffer; and third transistors respectively connected between the second terminal of each of the p capacitors and the current sink, the third transistors being of a conduction type different from a conduction type of the second transistors.

6. The data driving circuit as claimed in claim 5, wherein the decoder turns on the second transistors during the first partial period, and supplies the first supply voltage to the respective second terminals of the p capacitors.

7. The data driving circuit as claimed in claim 5, wherein capacitances of the p capacitors are set to binary weighted values.

8. The data driving circuit as claimed in claim 7, wherein the decoder turns on and off the third transistors based on a number of bits of the second data and during the second partial period, the decoder selectively controls a supply of the compensation voltage to the respective second terminals of the p capacitors.

9. The data driving circuit as claimed in claim 1, wherein the current sink comprises:

a source providing the predetermined current;

a first transistor disposed between the data line connected to the pixel and the voltage controller, the first transistor being turned on during the first partial period;

a second transistor disposed between the data line and the current source, the second transistor being turned on during the first partial period;

a capacitor storing the compensation voltage; and a buffer disposed between the first transistor and the voltage controller, the buffer selectively transferring the compensation voltage to the voltage controller.

10. The data driving circuit as claimed in claim 9, wherein a current value of the predetermined current is equal to a current value of a minimum current flowing through the pixel when the pixel emits light with maximum brightness, and maximum brightness corresponds to a brightness of the pixel when a highest one of the plurality of reset gray scale voltages is applied to the pixel.

11. The data driving circuit as claimed in claim 1, wherein the switching unit comprises at least one transistor which is turned on during the second partial period.

12. The data driving circuit as claimed in claim 11, wherein the switching unit comprises two transistors which are connected so as to form a transmission gate.

13. The data driving circuit as claimed in claim 1, further comprising:

a shift register unit including at least one shift register for sequentially generating a sampling pulse;

a sampling latch unit including at least one sampling latch for receiving the first data in response to the sampling pulse; and a holding latch unit including at least one holding latch for receiving the first data stored in the sampling latch and supplying the first data stored in the holding latch to the digital-analog converter and the decoder.

14. The data driving circuit as claimed in claim 13, further comprising:

a level shifter for selectively modifying a voltage level of the first data stored in the holding latch and supplying the first data to the digital-analog converter and the decoder.

15. A light emitting display receiving externally supplied first data, comprising:

a pixel unit including a plurality of pixels connected to n scan lines, a plurality of data lines, and a plurality of emission control lines;

a scan driver respectively and sequentially supplying, during each scan cycle, n scan signals to the n scan lines, and for sequentially supplying emission control signals to the plurality of emission control lines; and a data driver including a current sink receiving a predetermined current from respective ones of the pixels selected by a first scan signal during a first partial period of a complete period and respective compensation voltages being generated based on the predetermined current received by the current sink, respectively controlling voltage values of data signals using the respective compensation voltages supplied from the current sink and respective second data generated by converting the respective first data into second data using binary weighted values, and respectively supplying the data signals, with the controlled voltage values, to the data lines during a partial period of the complete period that elapses after the first partial period of the respective complete period associated with each of the respective pixels.

16. The light emitting display as claimed in claim 15, wherein each of the pixels is connected to two of the n scan lines, and during each of the scan cycles, a first of the two scan lines receiving a respective one of the n scan signals before a second of the two scan lines receives a respective one of the n scan signals, and each of the pixels comprises:

a first power source;

a light emitter receiving current from the first power source;

first and second transistors each having a first electrode connected to the respective one of the data lines associated with the pixel, the first and second transistors being turned on when the first of the two scan signals is supplied;

a third transistor having a first electrode connected to a reference power source and a second electrode connected to a second electrode of the first transistor, the third transistor being turned on when the first of the two scans signal is supplied;

a fourth transistor controlling an amount of current supplied to the light emitter, a first terminal of the fourth transistor being connected to the first power source; and a fifth transistor having a first electrode connected to a gate electrode of the fourth transistor and a second electrode connected to a second electrode of the fourth transistor, the fifth transistor being turned on when the first of the two scan signals is supplied such that the fourth transistor operates as a diode.

17. The light emitting display as claimed in claim 16, wherein each of the pixels comprises:

a first capacitor having a first electrode connected to one of a second electrode of the first transistor or the gate electrode of the fourth transistor and a second electrode connected to the first power source; and a second capacitor having a first electrode connected to the second electrode of the first transistor and a second electrode connected to the gate electrode of the fourth transistor.

18. The light emitting display as claimed in claim 16, wherein each of the pixels further comprises a sixth transistor having a first terminal connected to the second electrode of the fourth transistor and a second terminal connected to the light emitter, the sixth transistor being turned off when the respective emission control signal is supplied, wherein the current sink in the data driver receives the predetermined current from the pixel during a first partial period of one complete period for driving the pixel, the first partial period occurring before a second partial period of the complete period for driving the pixel, and the sixth transistor is turned on during the second partial period of the complete period for driving the pixel.

19. A method for driving a light emitting display, comprising:

selecting, as a data signal, one of a plurality of gray scale voltages based on k bits of externally supplied first data, k being a natural number;

converting the first data into a binary weighted value and generating p bits of second data, p being a natural number;

receiving in a current sink a predetermined current from a pixel selected by a scan signal during a first partial period of a complete period for driving the pixel based on the selected gray scale voltage, generating a compensation voltage based on the predetermined current when the predetermined current is received by the current sink;

controlling a voltage value of the data signal using the generated second data and the generated compensation voltage supplied from the current sink; and after controlling the voltage value of the data signal, supplying the data signal to the pixel, the data signal being supplied to the pixel during a second partial period of the complete period for driving the pixel.

20. The method as claimed in claim 19, further comprising generating the plurality of gray scale voltages by distributing a voltage between reference supply voltage and a first supply voltage among a plurality of voltage dividing resistors.

21. The method as claimed in claim 19, wherein controlling the voltage value of the data signal comprises:

supplying a voltage value of a first power source to a first terminal of a each of a plurality of capacitors during the first partial period; and selectively controlling a supply of the compensation voltage to the respective second terminals of the plurality of capacitors based on a number of bits of the second data, during a second partial period of the complete period.

22. A data driving circuit for driving a light emitting display, comprising:

selecting means for selecting, as a data signal, one of a plurality of gray scale voltages based on k bits of externally supplied first data, k being a natural number;

converting means for converting the first data into a binary weighted value and generating p bits of second data, p being a natural number;

receiving means for receiving predetermined current from a pixel selected by a scan signal during a first partial period of a complete period for driving the pixel based on the selected gray scale voltage, and a compensation voltage being generated based on the predetermined current when the predetermined current is received from the pixel;

voltage controlling means for controlling a voltage value of the data signal using the generated second data and the generated compensation voltage supplied from the current receiving means to the voltage controlling means; and after controlling the voltage value of the data signal, supplying the data signal to the pixel, the data signal being supplied to the pixel during a second partial period of the complete period for driving the pixel.

* * * * *

UNITED STATES PATENT AND TRADEMARK OFFICE

CERTIFICATE OF CORRECTION

PATENT NO. : 7,893,897 B2
APPLICATION NO. : 11/491880
DATED : February 22, 2011
INVENTOR(S) : Bo Yong Chung et al.

It is certified that error appears in the above-identified patent and that said Letters Patent is hereby corrected as shown below:

Title page, in the heading of the patent, paragraph Item (73) is amended to read as follows:

Item (73) Assignee: SAMSUNG MOBILE DISPLAY CO., LTD.,
Suwon-si, Gyeonggi-do, (KR)

and

IUCF-HYU (Industry-University Coopeation Foundation Hanyang University) HANYANG UNIVERSITY,
Seongdong-gu, Seoul (KR)

Signed and Sealed this
Twenty-seventh Day of September, 2011

David J. Kappos

David J. Kappos
*Director of the United States Patent and Trademark Office*